US012345502B2

(12) United States Patent
Oakshott et al.

(10) Patent No.: US 12,345,502 B2
(45) Date of Patent: Jul. 1, 2025

(54) PORTABLE FIREARM SAFETY SYSTEM

(71) Applicant: ULTIMATE DEFENSE TECHNOLOGIES, LLC, Peoria, AZ (US)

(72) Inventors: Neil Oakshott, Walsall (GB); Jeffrey Orr, Phoenix, AZ (US); Rob Johnson, Phoenix, AZ (US); Ryan Parker, Phoenix, AZ (US); Christopher Miller, Draper, UT (US)

(73) Assignee: Ultimate Defense Technologies, LLC, Billings, MT (US)

( * ) Notice: Subject to any disclaimer, the term of this patent is extended or adjusted under 35 U.S.C. 154(b) by 138 days.

(21) Appl. No.: 18/209,946

(22) Filed: Jun. 14, 2023

(65) Prior Publication Data

US 2024/0068771 A1 Feb. 29, 2024

Related U.S. Application Data

(60) Provisional application No. 63/425,239, filed on Nov. 14, 2022, provisional application No. 63/400,997, filed on Aug. 25, 2022.

(51) Int. Cl.
*F41C 33/02* (2006.01)

(52) U.S. Cl.
CPC ..... *F41C 33/0263* (2013.01); *F41C 33/0272* (2013.01); *F41C 33/029* (2013.01)

(58) Field of Classification Search
CPC . F41C 33/0263; F41C 33/0272; F41C 33/029
See application file for complete search history.

(56) References Cited

U.S. PATENT DOCUMENTS

| | | | | |
|---|---|---|---|---|
| 2,465,057 | A | 3/1949 | Brandes | |
| 2,754,991 | A | 7/1956 | Hagerty et al. | |
| 4,987,836 | A | 1/1991 | Owen | |
| 5,884,989 | A * | 3/1999 | Truelove | F41C 33/06 109/52 |
| 8,186,188 | B1 * | 5/2012 | Brown | E05G 1/005 109/45 |
| 9,829,275 | B2 * | 11/2017 | Madrid | F41C 33/0209 |
| 2006/0236583 | A1 * | 10/2006 | Pikielny | F41G 11/003 42/85 |
| 2011/0162564 | A1 * | 7/2011 | Heim | E05G 1/026 109/48 |
| 2018/0209761 | A1 * | 7/2018 | Erickson | F41C 33/0245 |

* cited by examiner

*Primary Examiner* — Derek J Battisti
(74) *Attorney, Agent, or Firm* — Noblitt & Newson, PLLC

(57) ABSTRACT

A gun safety system can include a mount assembly comprising a mounting rail and a first lock mechanism, the mount assembly configured to secure the mounting rail to a support structure; and a gun safe assembly comprising an outer housing and an inner housing assembly disposed within the outer housing, the inner housing assembly including a sleeve at least partially defining a gun storage cavity, the outer housing comprising a first mounting rail guide, the first lock mechanism being accessible through the gun storage cavity in response to the gun safety system being in a docked configuration.

20 Claims, 15 Drawing Sheets

Detail A

PORTABLE FIREARM SAFETY SYSTEM

CROSS-REFERENCE TO RELATED APPLICATIONS

This application is a non-provisional of, and claims priority to, and the benefit of U.S. Provisional Application No. 63/400,997, entitled "PORTABLE FIREARM SAFETY SYSTEM," filed on Aug. 25, 2022, and this application claims priority to, and the benefit of U.S. Provisional Application No. 63/425,239, entitled "PORTABLE FIREARM SAFETY SYSTEM," filed on Nov. 14, 2022, both of which are hereby incorporated by reference in their entireties for all purposes.

FIELD

The present disclosure relates to portable safes, and more specifically, portable safes for firearms.

BACKGROUND

Currently, handgun and long gun holsters as well as lock boxes are not typically easily transportable. To transfer a weapon between a home/workplace storage location and a vehicle, the weapon must typically be removed from a residential safe or strong box, then carried to the vehicle (and vice versa). During transfer it is possible that the weapon could be stolen, damaged, and/or inadvertently fired. Annually within the United States there are thousands of instances where people are killed or severely injured due to the accidental firing of a gun.

The number of property and vehicle break-ins where firearms are the primary target has increased year-on-year across the United States. Lock boxes and safes provide residential security and resistance to theft but are often difficult to access in the case of the gun owner needing to urgently retrieve a weapon. Human performance tests demonstrate that under unusually extreme stressful conditions even simple tasks, such as opening a standard key lock, entering a four-digit security code, or using a fingerprint reader to open a lock, become overly complex. Within vehicles weapons are typically left in center consoles or gloveboxes when a holster is not in use, or an under-dash magnet is used (i.e., weapons are openly visible to a possible thief).

Additionally, many secure holsters, lock boxes and gun safes are relatively easy to maliciously force open and locks can be broken using simple tools such as screwdrivers and knives. Likewise, it is a fairly easy process on many models to reset four-digit access codes or "spoof" fingerprint readers on products where a keypad or reader is fitted.

The theft of a lock box or safe containing a weapon is difficult to track unless a third-party Bluetooth transmitting tag has been installed. These devices usually have a short service life and relatively short range, so provide only a limited window for owners and law enforcement to be able to track an object once a theft has been reported.

SUMMARY

Disclosed herein is a portable gun safety system. In various embodiments, the portable gun safety system is configured to be transportable and able to be secured into a static position within buildings and vehicles via a mounting base (i.e., a docking station for a portable firearm safe). During transfer of the portable firearm safe from one point to another, a weapon can be securely locked and inaccessible within the portable firearm safe but can still be quickly retrieved if needed.

The portable gun safety system comprises a gun safe assembly and a mounting assembly. The gun safe assembly is configured to be securely mounted to the mounting assembly. The gun safe assembly can be dismounted from the mounting assembly only after first unlocking the gun safe assembly (i.e., after a door assembly of the gun safe assembly is opened) and disengaging a locking mechanism that is disposed internal to the gun safe assembly when the gun safe assembly is docked on the mounting assembly.

In various embodiments, a lid of the door assembly is configured to be flush with the outer housing in response to the gun safe assembly being in a locked state.

In various embodiments, the gun safe assembly is configured to provide physical separation between internal components of the gun safe assembly and a cavity defined by a sleeve of an inner housing assembly.

In various embodiments, the gun safe assembly can include an electronic device configured for short-range radio frequency communication (e.g., Bluetooth® connectivity or the like).

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the following detailed description and claims in connection with the following drawings. While the drawings illustrate various embodiments employing the principles described herein, the drawings do not limit the scope of the claims.

DETAILED DESCRIPTION

Figure 1A:
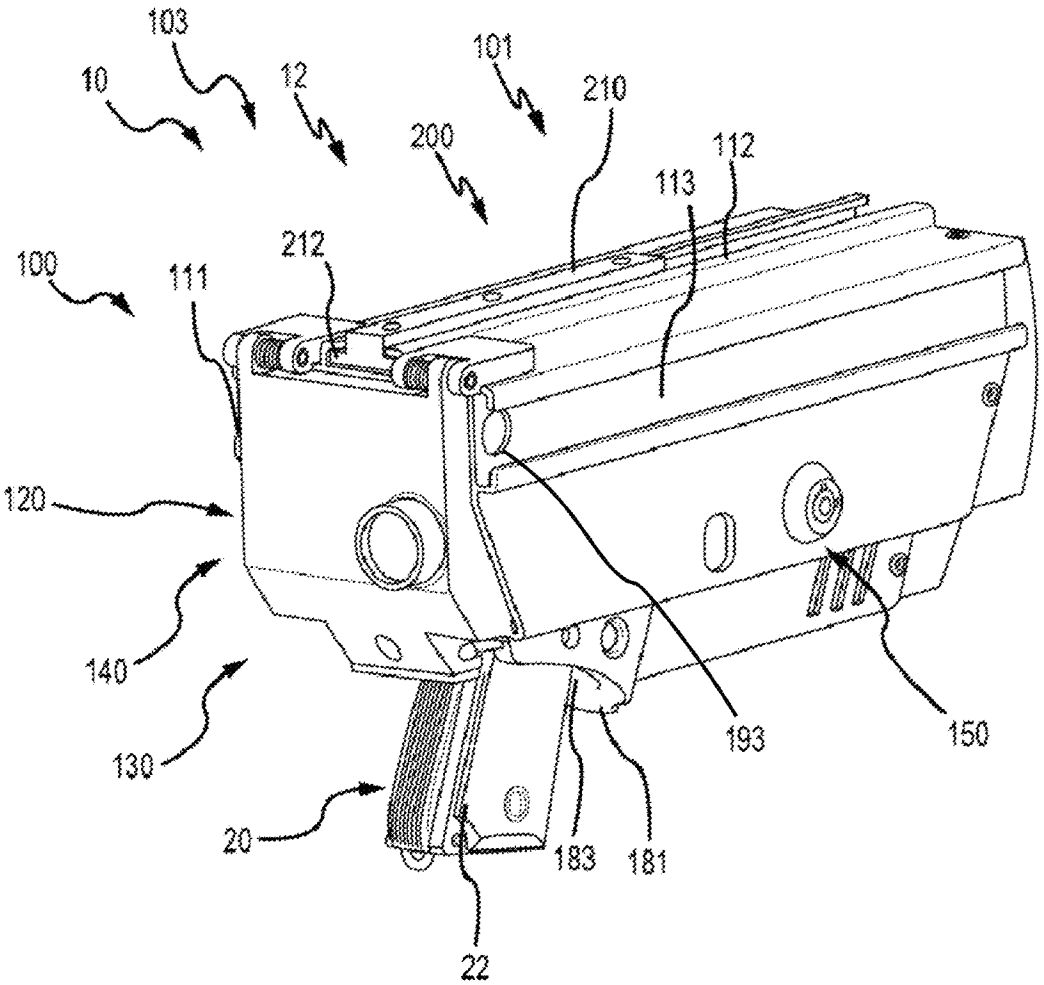
FIG. 1A illustrates a perspective view of a gun safety system in a docked configuration and a locked state, in accordance with various embodiments.

The following detailed description of various embodiments herein refers to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

Disclosed herein is a gun safety system. In various embodiments, the gun safety system comprises a gun safe assembly and a mount assembly. The gun safe assembly is configured to hold at least of a portion of a gun in an internal cavity of the gun safe assembly. The mount is configured to couple to a component (e.g., a dashboard of a vehicle, a panel assembly of a vehicle, a desk, etc.). The present disclosure is not limited in this regard.

In various embodiments, the gun safety system is designed to be simple to operate and unobtrusive. In various embodiments, an outer shell of the gun safety system can include neutral colors to meld the outer shell into a dashboard or a panel assembly of a vehicle in response to being mounted within the vehicle. To relieve stress-related issues in the use of fingerprint and keypad locks, and to enable fast opening of the container, the gun safety system can incorporate a unique identifier locking mechanism (e.g., a radio frequency identification ("RFID") locking system) that can control the opening and closing of an electric linear actuator, in accordance with various embodiments. In the event of a failure of the RFID lock, then a backup manual lock (e.g., a standard key lock or a single button) can provide an emergency lock override signal, in accordance with various embodiments.

In various embodiments, the gun safety system is designed with concealed lock parts and a flush lid that will prevent instruments such as screwdrivers and knives being used to lever the container open. Additional design features, such as low-profile hinges and a lid edge "loop", can provide further mechanical and anti-tamper security measures. To ensure a tight fit to the mounting rail, integral mounting rail guides can be built into the outer shell of the gun safety system to fully conceal the rail. The mounting rail release button can have limited accessibility (e.g., only becomes accessible when the lid is fully open), and as such it will not be possible to depress the button when the lid of the gun safety system is closed.

In various embodiments, tracking of the gun safe assembly can be enabled by embedding an onboard global positioning system ("GPS") that will be accessible via a user device (e.g., through a graphical user interface or the like). However, in some embodiments, a GPS system may be undesirable because a GPS system can add weight, cost, complexity, additional fault points in an electronic system, and/or increase a number of components. In this regard, tracking of the gun safe assembly can be decided by a user. For example, the gun safe assembly can comprise an auxiliary storage system capable of housing a tracking device that can be purchased by a user, in accordance with various embodiments. As such, a user can determine whether tracking of the gun safe assembly is desirable and purchase a tracking device that can be stored in the auxiliary storage system to add a tracking capability to the gun safe assembly, in accordance with various embodiments.

In an embodiment with an onboard GPS system, an onboard power supply can provide a threshold period of continuous operation of the GPS (e.g., greater than 72 hours or the like).

In various embodiments, the housing can be fitted with an alarm system (e.g., capable of 120 dBA) that can operate when the system is tampered with (i.e., the correct procedure to mount/unmount the container from the mounting rail is not adhered to).

In various embodiments, the gun safety system includes a concealed and secure mounting rail that can be unlocked when a lid of the gun safety system is open. In this regard, the gun safety system is secured at a docked location and can only be moved from the docked location after the lid of the gun safety system is opened (i.e., after a lock of the system is unlocked and the lid is opened). In various embodiments, the lid is tamperproof. In this regard, a threshold pressure to break the lock can be significantly greater than pressure generated from typical tools utilized in car jackings (e.g., crowbars, screwdrivers, etc.). In various embodiments, a holding force of the lock can be approximately 1,100 lbf (500 kg).

In various embodiments, various components are physically separated from a cavity that defines the holding space for a respective gun. For example, the gun safety system includes the inner sleeve, which houses the various components related to operation of the gun safety system and defines (e.g., on an inner surface) the cavity of the holding space for a respective gun. This inner sleeve provides a smooth surface that abuts the gun, which maintains the quality of the gun as it is stored. In various embodiments, the gun safety system is trackable (e.g., via a GPS or a removable tracking device). In various embodiments, the gun safety system can include Bluetooth connectivity. In this regard, the gun safety system can be configured to lock and unlock via a graphical user interface or the like, in accordance with various embodiments.

Referring now to FIG. 1A, a perspective view of a gun safety system 10 in use and in a docked configuration is illustrated, in accordance with various embodiments. The gun safety system 10 comprises a gun safe assembly 100 (e.g., a portable gun safe assembly) and a mount assembly 200. A "docked configuration," as disclosed herein, refers to the gun safe assembly 100 being coupled to (i.e., docked to) the mount assembly 200. A "portable gun safe assembly" as disclosed herein refers to a gun safe assembly that can be easily transported from one location to another. For example, the portable gun safe assembly can weigh less than 10 pounds (4.5 kg), or less than 8 pounds (3.6 kg), or less than 6 pounds (2.7 kg), and be within the scope of this disclosure. In various embodiments, the gun safe assembly 100 is between 3 pounds (1.4 kg) and 6 pounds (2.7 kg), or between 3.5 pounds (1.6 kg) and 5.5 pounds (2.5 kg).

The gun safe assembly 100 is configured to house at least a portion of a firearm 20 and secure the firearm 20 therein in a gun stowed configuration. A "gun stowed configuration" as described further herein refers to the gun safe assembly 100 with a firearm 20 secured therein, and the gun safe assembly 100 being in a locked state 101. A "locked state" as defined further herein refers to gun safe assembly 100 an internal cavity of the gun safe assembly 100 being inaccessible without unlocking the gun safe assembly 100 via a locking system (e.g., a manual lock, a sensor-based lock, a battery powered lock, a key code lock, a button activated lock, etc.).

As shown in FIG. 1A, a portion of the firearm 20 (e.g., a grip 22) can extend outward from the gun safe assembly 100 in the gun stowed configuration. In this regard, a weight and cost of the gun safe assembly 100 can be reduced by not housing the entirety of the firearm 20. For example, if the entire firearm 20 were to be housed, the gun safe assembly 100 would have to be significantly larger, have extra material, and would weigh more. Even though the gun safe assembly 100 allows the grip 22 to extend outward from a gun storage cavity 105 (as shown on FIG. 1B) of the gun safe assembly 100, security of the gun safe assembly 100 is not reduced. For example, a magazine release of the firearm 20 can be safely secured in the gun storage cavity 105 of the gun safe assembly 100, along with a trigger of the firearm 20. Additionally, in various embodiments, the grip 22 of the firearm 20 can abut a stock bumper 181 of the gun safe assembly 100 and be safely secured between the stock bumper 181 and a door assembly 120 of the gun safe assembly 100. In various embodiments, the stock bumper 181 can have tight tolerances to ensure a snug fit of the grip 22 of the firearm 20 and prevent any access of tools, such as screwdrivers, crowbars, etc., further securing the firearm 20 therein. Although described herein as housing only a portion of a firearm 20, the present disclosure is not limited in this regard, and a gun safe assembly that houses an entirety of the firearm 20 would still be within the scope of this disclosure.

As described further herein, the mount assembly 200 is configured to be coupled to a support structure (i.e., a panel in a car, a desk in an office, or the like). In various embodiments, the mount assembly 200 comprises a mounting structure (e.g., a mounting rail 210). In various embodiments, the mount assembly 200 is designed to ensure that the gun safety system 10 can be installed in the widest possible range of locations (e.g., vehicles, desks, buildings, furniture, etc.). The mount assembly 200 can include the mounting rail 210 (e.g., a universal flexible mounting rail) that is configured to be installed onto various support structures. For example, installation of the mount assembly 200 can be inside buildings, on furniture (e.g., desks and nightstands), as well as in vehicles.

As shown in FIG. 1A, the mounting rail 210 of the mount assembly 200 is configured to engage, and be securely coupled to, the gun safe assembly 100 in a docked configuration 12. In various embodiments, as described further herein, to disengage a locking mechanism of the mount assembly 200, the door assembly 120 of the gun safe assembly 100 must be open. Stated another way, the gun safe assembly 100 cannot be removed from the mount assembly 200 in the locked state, and the gun safe assembly 100 must be unlocked and the door assembly 120 opened to access the locking mechanism of the mount assembly 200. This feature of the gun safety system 10 (e.g., the locking mechanism of the mount assembly 200 only being accessible when the gun safe assembly 100 is unlocked), ensures that the gun safe assembly 100 remains in the docked configuration 12 (i.e., coupled to a support structure) while in use, providing additional safety while transporting the firearm 20.

The gun safe assembly 100 comprises a guide (e.g., a mounting rail guide 112) configured to receive the mounting structure (e.g., the mounting rail 210) of the mount assembly 200. In various embodiments, the gun safe assembly 100 is configured to transition between an un-docked configuration (i.e., where gun safe assembly 100 is disengaged from the mount assembly 200) and the docked configuration 12. In this regard, the mounting rail guide 112 can travel longitudinally along a flange 212 of the mounting rail 210 until the locking mechanism of the mount assembly 200 engages the gun safe assembly 100, resulting in the docked configuration 12 of the gun safety system 10 as described further herein. Similar to the flexibility of the mount assembly 200, the gun safe assembly 100 can comprise a plurality of the guide (e.g., the mounting rail guide 112) to provide flexibility for various docking configurations, in accordance with various embodiments. For example, the mounting rail guide 112 can be disposed on a top side of the gun safe assembly 100, a second mounting rail guide 111 can be disposed on a lateral side of the gun safe assembly 100, and/or a third mounting rail guide 113 can be disposed on a second lateral side of the gun safe assembly 100, in accordance with various embodiments.

The gun safe assembly 100 further comprises a locking system 130. The locking system 130 can comprise an electronic locking system 140 (e.g., an RFID lock, a key code lock, a button activated lock, a biometric lock, or the like), a manual locking system (e.g., a key lock, a dial lock, etc.), or a combination of the two. An "electronic locking system" as described further herein is any locking mechanism that utilizes an electronic (e.g., wireless or wired) input to transition the locking mechanism from a locked state to an unlocked state). Although described herein as comprising the electronic locking system 140 and the override locking system 150, the present disclosure is not limited in this regard. For example, an electronic locking system 140 could be the only locking system used for the gun safe assembly 100, or the override locking system 150 could be the only locking system used for the gun safe assembly 100 and the gun safe assembly 100 would still be within the scope of this disclosure. In various embodiments, by having both the electronic locking system 140 and the override locking system 150, a user could utilize the override locking system 150 if the electronic locking system 140 malfunctions or if a key for the electronic locking system 140 is lost (e.g., an RFID tag or the like).

In various embodiments, the electronic locking system 140 can comprise a biometric lock (e.g., a retina scanner, a fingerprint reader, or the like). In this regard, the biometric lock can be configured to receive a biometric input, compare the biometric input (e.g., a fingerprint scan, a retina scan, etc.) to a biometric data for a user, and command unlocking of the electronic locking system 140 in response to the biometric input matching the biometric data.

Figure 1B:
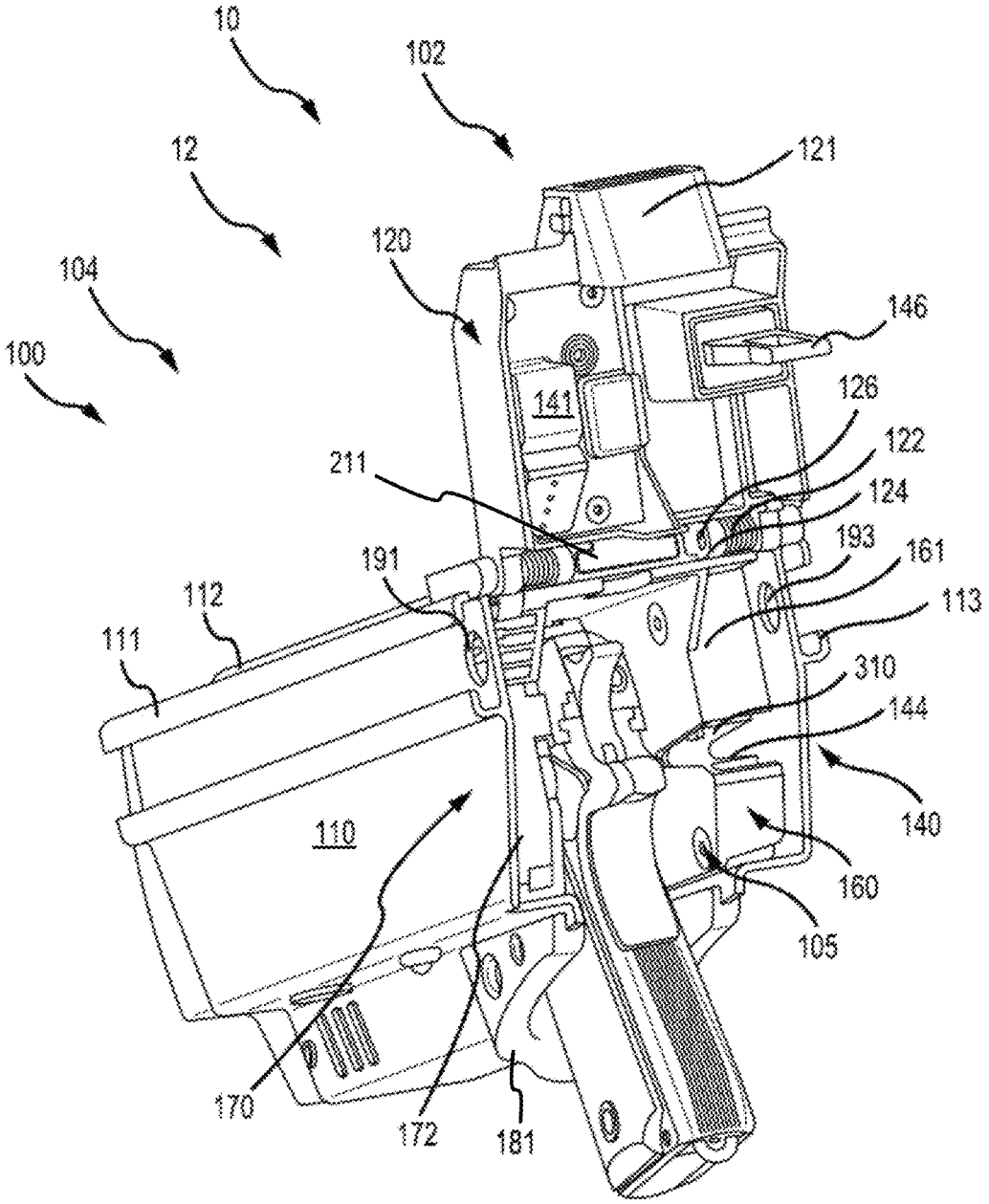
FIG. 1B illustrates a perspective view of a gun safety system in a docked configuration and an unlocked state, in accordance with various embodiments.

Referring now to FIG. 1B, a perspective view of the gun safety system 10 from FIG. 1A in the docked configuration 12 with the gun safe assembly 100 in an unlocked state 102 is illustrated, in accordance with various embodiments. With combined reference to FIGS. 1A and 1B and in accordance with various embodiments, the electronic locking system 140 can comprise a sensor 141 (e.g., an RFID sensor, a biometric sensor, or the like). The sensor 141 can be in electronic communication (e.g., wirelessly through a transmitter and receiver, or electrically through a wire) with a lock mechanism 144. In this regard, in response to sensor 141 (e.g., RFID sensor 142) receiving a sensor input (e.g., an RFID tag), the lock mechanism 144 can actuate the lock mechanism 144 (e.g., disengaging a lock jaw 310 of FIG. 3, of the lock mechanism 144 from latch arm 146), and allowing a lid 121 of the door assembly 120 to pivot from a closed state 103 as shown in FIG. 1A to an open state 104 as shown in FIG. 1B.

In various embodiments, the door assembly 120 is biased towards an open state 104 as shown in FIG. 1B. In this regard, in response to the sensor 141 receiving the sensor input, and the lock mechanism 144 actuating to disengage a lock jaw 310 from the latch arm 146, the door assembly 120 can swing open, in accordance with various embodiments. In various embodiments, the lid 121 is pivotably coupled to an outer housing 110 of the gun safe assembly 100 (e.g., via torsion springs 122 and hinge mounts 124, and dowel pins 126). However, the present disclosure is not limited in this regard. For example, the door assembly 120 could be configured to open in various ways and still be within the scope of this disclosure, such as slidingly opening, along a guided track, or the like.

In response to transitioning from the locked state 101 (i.e., closed state 103) in FIG. 1A, to the unlocked state 102 (i.e., open state 104) in FIG. 1B, the firearm 20 can be removed from the gun storage cavity 105 of the gun safe assembly 100 and/or the gun safe assembly 100 can be de-coupled from the mount assembly 200. For example, each mounting rail guide (e.g., mounting rail guide 111, mounting rail guide 112, mounting rail guide 113) has an aperture (e.g., aperture 191 for mounting rail guide 111 and aperture 193 for mounting rail guide 113). With brief reference now to FIG. 1C, an aperture 192 through a mounting rail guide 112 can provide access to a lock mechanism 144 (e.g., push button 222 of the mount assembly 200). In this regard, to disengage the gun safe assembly 100 from the mounting rail 210 of the mount assembly 200, the push button 222 can be pressed into the mounting rail 210 as described further herein, and the gun safe assembly 100 can translate longitudinally along the mounting rail 210 through the mounting rail guide 112. Once the push button 222 passes the aperture 192, the push button 222 will provide a slight force to an outer surface of the outer housing 110, but the gun safe assembly 100 may still slide with ease during dismounting of the gun safe assembly 100 from the mount assembly 200, in accordance with various embodiments. A "push button" as referred to herein, can comprise any mechanical object that depresses in response to pressure on an outer surface. For example, the push button 222 can comprise a flexible push button that flexes in response to outside pressure, a hard push button that depresses into a recess in response to pressure, or the like. The present disclosure is not limited in this regard.

In various embodiments, the gun safe assembly 100 further comprises an inner housing assembly 160 disposed within the outer housing 110. In various embodiments, the gun safe assembly further comprises an auxiliary storage system 170. The auxiliary storage system 170 can comprise a cavity disposed laterally between sleeve body 161 of the inner housing assembly 160 and the outer housing 110. The auxiliary storage system 170 can comprise a door 172 hingedly coupled to the sleeve body 161. Although described herein as being hingedly coupled to the sleeve body 161, the present disclosure is not limited in this regard. For example, the door 172 can be slidingly coupled, or coupled in any other manner known in the art, and still be within the scope of this disclosure. In various embodiments, the auxiliary storage system 170 can be utilized to store credit cards, cash, a tracking device or the like. The present disclosure is not limited in this regard.

Figure 1C:
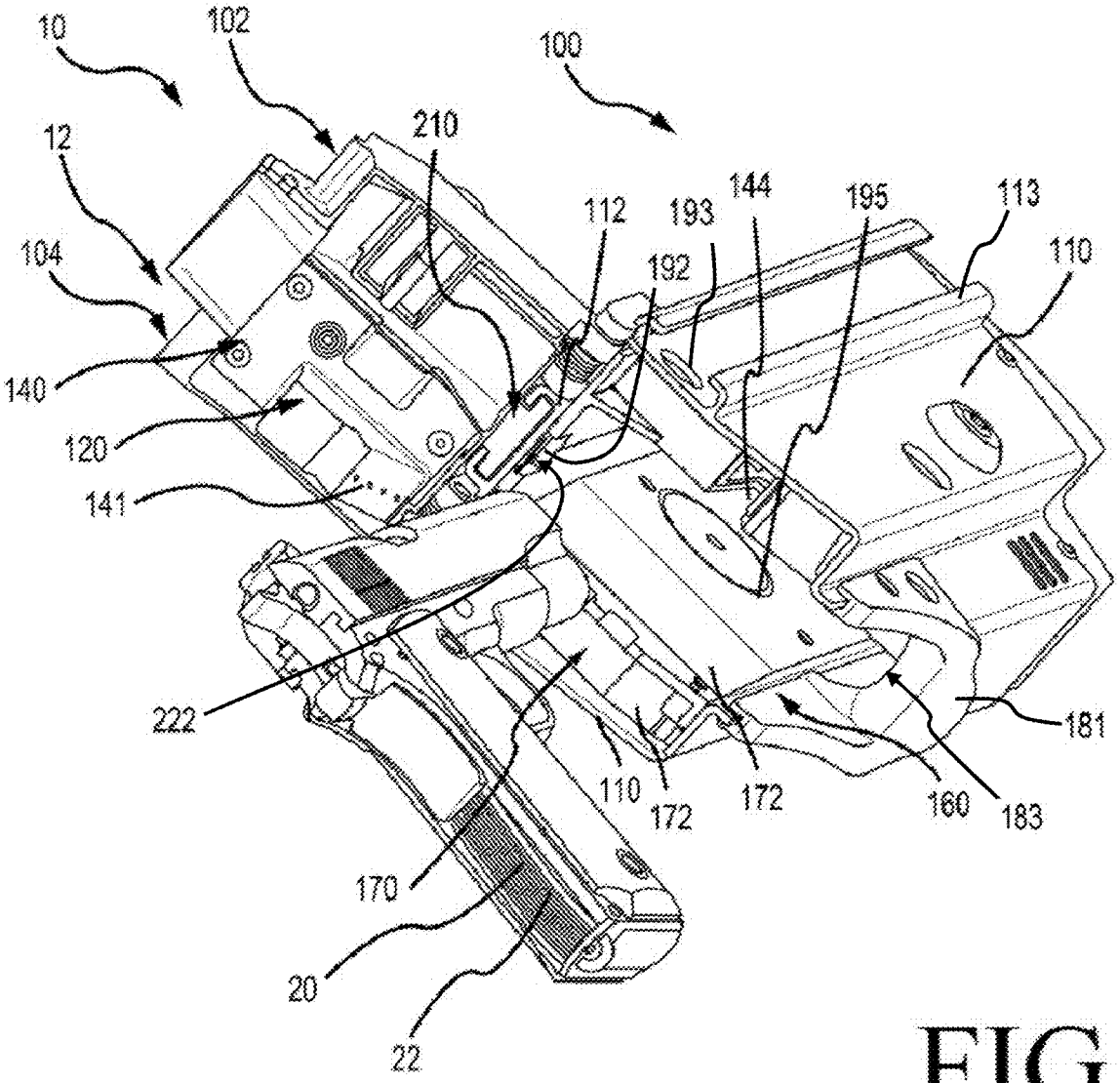
FIG. 1C illustrates a perspective view of a gun safety system in a docked configuration and an unlocked state, in accordance with various embodiments.

With continued reference to FIG. 1C, a perspective view of the gun safety system 10 in the docked configuration 12 with the gun safe assembly 100 in an unlocked state 102 is illustrated, in accordance with various embodiments. In the unlocked state 102, the firearm 20 can easily be retrieved and ready for use. For example, as described previously herein, the door assembly 120 can be biased towards an open state 104, and the electronic locking system 140 can comprise a sensor 141 that unlocks the lock mechanism 144 in response to receiving a sensor input (e.g., from an RFID tag). Thus, in response to quickly scanning an RFID tag, the door assembly 120 can quickly transition from the closed state 103/locked state 101 from FIG. 1A to the open state 104/unlocked state 102 of FIGS. 1B, 1C, providing quick easy access to the grip 22 of the firearm 20 for use in an emergency.

In various embodiments, the gun safe assembly 100 can further comprise a magnet 195 (e.g., a permanent magnet) disposed within the gun safe assembly 100. In this regard, the magnet 195 can supply an attractive force to the firearm 20 from FIG. 1A while the firearm 20 is being stored. In this regard, the gun safe assembly 100 can secure the firearm 20 within the gun storage cavity 105 while the firearm 20 is disposed therein, in accordance with various embodiments.

Figure 2A:
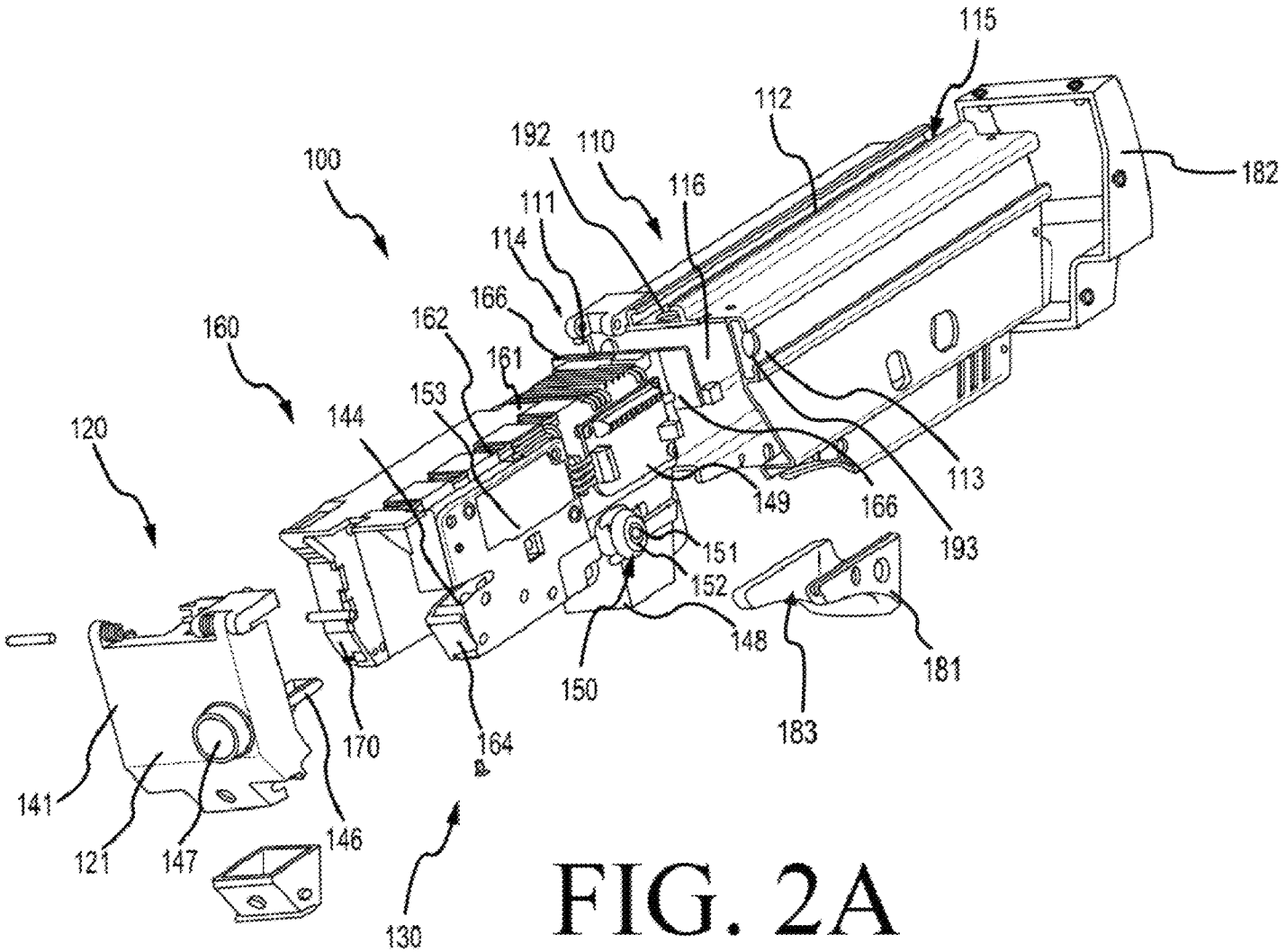
FIGS. 2A and 2B illustrate a perspective exploded view of the gun safe assembly.
Figure 2B:
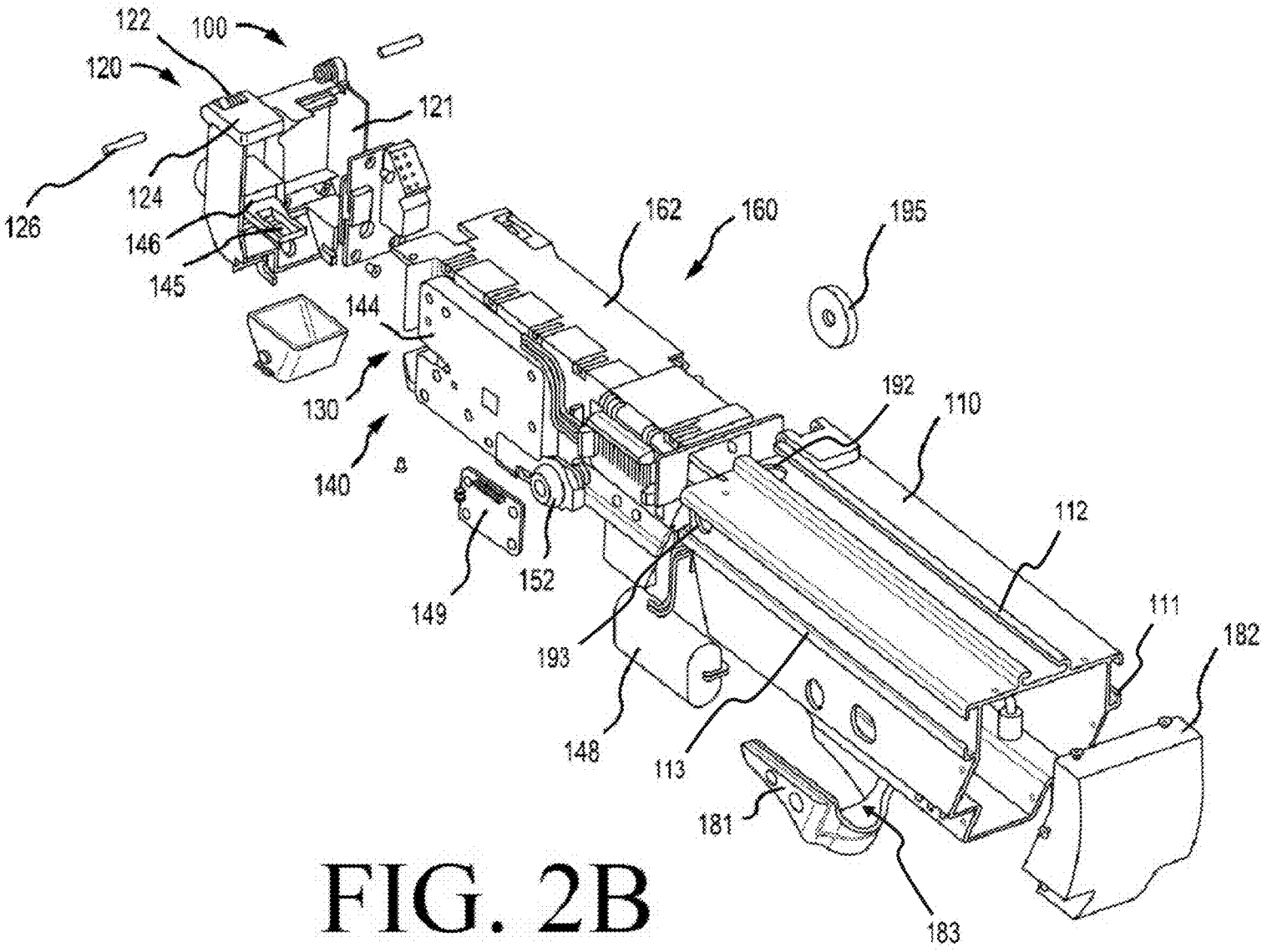

Referring now to FIGS. 2A and 2B, exploded views of the gun safe assembly 100 are illustrated, with like numerals depicting like elements, in accordance with various embodiments. As described previously herein, the gun safe assembly 100 comprises an outer housing 110, an inner housing assembly 160, a door assembly 120, and the locking system 130. In various embodiments, the gun safe assembly 100 further comprises an end cap 182. However, the present disclosure is not limited in this regard. For example, the outer housing 110 can be formed as a monolithic component having a closed end where end cap 182 is disposed and be within the scope of this disclosure. However, the end cap 182 can greatly reduce manufacturing cost for the outer housing 110, as the outer housing 110 can be extruded to form a hollow cavity, as opposed to utilizing a machining process for a monolithic outer housing that doesn't have the end cap 182, in accordance with various embodiments. In various embodiments, the end cap 182 can comprise a metallic material (e.g., aluminum, steel, a nickel-based alloy, or the like). However, the present disclosure is not limited in this regard. For example, a carbon-fiber composite or the like would be within the scope of this disclosure.

The outer housing 110 extends from a first longitudinal end 114 to a second longitudinal end 115. The outer housing 110 defines a hollow channel 116 extending from the first longitudinal end 114 to the second longitudinal end 115. In various embodiments, the outer housing 110 comprises the mounting rail guide 111, the mounting rail guide 112, and/or the mounting rail guide 113. In various embodiments, the outer housing 110 is a monolithic component (i.e., formed of a single piece). In this regard, a lateral cross-section (i.e., a cross section through a plane that is perpendicular to a longitudinal axis defined by the outer housing 110) can be substantially uniform (except for apertures and/or other cuts that are created after extruding the outer housing 110). In this regard, the outer housing 110 can be manufactured by extruding a metal (e.g., aluminum), to form a shell of the outer housing 110, and post processing the shell via computer numerical control machining to generate apertures through the outer housing 110. However, the present disclosure is not limited in this regard.

In various embodiments, by having the mounting rail guides 111, 112, 113 integral (i.e., formed of a single piece) with the outer housing 110, the mounting rail guides 111, 112, 113 are more securely coupled to the gun safe assembly 100 providing a stronger coupling to the mount assembly 200 from FIGS. 1A-C relative to mounting rail guides 111, 112, 113 that are not integral with the outer housing 110. In various embodiments, by having the outer housing 110 designed with open ends at the first longitudinal end 114 and the second longitudinal end 115, an efficient and quick assembly process for the gun safe assembly 100 can be facilitated, in addition to the benefits the open ends provide for manufacturing the outer housing 110. In this regard, inner components of the gun safe assembly 100 can easily be mounted within the cavity of the outer housing 110 during an assembly process, in accordance with various embodiments.

The door assembly 120 is disposed at the first longitudinal end 114 and coupled to the outer housing 110 and/or a sleeve 162 of the inner housing assembly 160. The present disclosure is not limited in this regard. In various embodiments, the door assembly 120 is coupled to an external surface of the outer housing 110 (e.g., as shown in FIG. 1A).

In various embodiments, the gun safe assembly 100 further comprises the stock bumper 181 coupled to the outer housing 110. In various embodiments, the stock bumper 181 is configured to allow a handle of a firearm 20 from FIG. 1A to hang outside the outer housing 110 without providing access (e.g., via a screwdriver a crowbar, or the like) to the gun storage cavity 105 from FIG. 1B. For example, in the closed state 103/locked state 101 of FIG. 1A, the stock bumper 181 and the lid 121 of the door assembly 120 define a slot 183 as shown in FIG. 1A, through which a handle of a gun can extend through in response to the firearm 20 being stored in the gun safe assembly 100. In various embodiments, the stock bumper 181 can facilitate a gun safe assembly 100 that is lighter weight and/or has less material, while maintaining safe storage of a gun disposed therein as described previously herein.

In various embodiments, the gun safe assembly 100 further comprises a override locking system 150. Although illustrated as a key switch 152, the present disclosure is not limited in this regard. For example, the override locking system 150 can comprise a second electronic locking system, such as a programmable push button, a programmable coded pad, or the like to act as an override if the electronic locking system 140 malfunctions or if a key for the electronic locking system 140 is lost. In this regard, the locking system 130 can comprise a main locking system (e.g., electronic locking system 140), and an override locking system (e.g., a second electronic locking system configured to function independently of the electronic locking system 140 or an override locking system 150) to provide redundancy and protect a user from being locked out of the user's gun safe assembly 100.

In various embodiments, in response to a key being inserted into the key receptacle of the key switch 151, the arm 153 of the key switch 152 can be rotated within the gun safe assembly 100 (e.g., between the sleeve 162 and the outer housing 110) toward the lock mechanism 144. In this regard, the arm 153 can disengage a lock jaw 310 of the lock mechanism 144 from the latch arm 146 to transition the gun safe assembly 100 from a locked state 101 from FIG. 1A to an unlocked state 102 from FIG. 1B if the electronic locking system 140 is unavailable for any reason. In this regard, the override locking system 150 can be configured to override the electronic locking system 140, in accordance with various embodiments.

In various embodiments, the outer housing 110 can comprise a metal material. For example, the outer housing 110 can comprise an aluminum shell. However, the present disclosure is not limited in this regard. For example, the outer housing 110 can be constructed from various materials (e.g., carbon fiber composite, steel, a nickel-based alloy, or the like) and remain within the scope of this disclosure. In various embodiments, the outer housing 110 can be an extruded aluminum shell. In this regard, the outer housing 110 can be manufactured in a quick, efficient, and/or inexpensive manner, in accordance with various embodiments. Additionally, in various embodiments, aluminum is lighter relative to typical metals, further facilitating a transportability (or portability) of the gun safe assembly 100, in accordance with various embodiments.

In various embodiments, the inner housing assembly 160 comprises a sleeve 162. The sleeve 162 can comprise flanges 164 at a first longitudinal end and flanges 166 at a second longitudinal end 115 that extend outward from a sleeve body 161 of the sleeve 162. The sleeve body 161 extends longitudinally from the first longitudinal end of the second longitudinal end 115 of the sleeve 162 in a similar manner to the outer housing 110. In various embodiments, the flanges 164, 166 can hide the electronics and other components of the gun safe assembly 100 and ensure that the gun storage cavity 105 is configured to protect the firearm 20 from FIG. 1A during transport of the firearm 20 as described further herein.

In various embodiments, the sleeve 162 can be constructed from a fiber-reinforced polymeric (e.g., nylon or other type of fabric) inner sleeve. In this regard, the sleeve 162 can protect the firearm 20 being stored (e.g., firearm 20 from FIGS. 1A-C) within the gun safe assembly 100 from damage during transport, in accordance with various embodiments. In an assembled state, the inner housing assembly 160 is housed within the outer housing 110. The outer housing 110, the end cap 182, and the door assembly 120 encapsulate the inner housing assembly 160 within a cavity defined by the outer housing 110, the end cap 182, and the door assembly 120 as shown in FIGS. 1B and 1C, in accordance with various embodiments. In this regard, none of the components of the inner housing assembly 160 are accessible in response to a gun safe assembly 100 being in the locked state 101/closed state 103 of FIG. 1A.

In various embodiments, the door assembly 120 comprises a lid 121. In various embodiments, the lid 121 comprises a fiber-reinforced polymeric (e.g., nylon or another type of fabric) lid. However, the present disclosure is not limited in this regard, and various materials (e.g., thermoplastics, metallic based materials, or the like). In various embodiments, by having a polymeric material, the lid 121 can be lighter and easier to manufacture relative to a metallic lid without sacrificing much with respect to strength and robustness, thus facilitating a more easily transportable gun safe assembly 100 without sacrificing security of the firearm 20 disposed therein during transport. A "lid" as referred to herein can comprise any covering, closure device, or the like. In this regard, a "lid" comprises any structure capable of closing an opening, in accordance with various embodiments.

In various embodiments, a magnet 195 can be coupled to the sleeve 162 and configured to provide a securing force to the firearm 20 during transport to further protect the firearm 20. For example, the magnet 195 can be configured to generate a magnetic force attracting a respective firearm 20 (e.g., attracting a ferromagnetic metal of the firearm 20) stored in the gun safe assembly 100.

In various embodiments, various components can be fixedly coupled to the sleeve 162. In this regard, the sleeve 162, can act as a barrier between the various components and the gun storage area (i.e., the cavity defined by the sleeve 162). The sleeve 162 can also act as a protective barrier between the outer housing 110 and any stored gun. In various embodiments, the inner housing assembly 160 further comprises the lock mechanism 144 (e.g., a 6-volt direct current lock or the like), a power source 148 (e.g., a battery), and a printed circuit board ("PCB") 149. In this regard, the lock mechanism 144, the power source 148, and the PCB 149 are installed onto sleeve 162 of the inner housing assembly 160, in accordance with various embodiments. In various embodiments, the PCB 149 comprises a light emitting diode ("LED") and a battery charger as described further herein. In various embodiments, the LED is configured to illuminate the gun storage area in response to the gun safe assembly 100 being in an unlocked state 102.

In various embodiments, the lid 121 of the door assembly 120 is configured to be secured to the inner housing assembly 160 via engagement between the latch arm 146 and the lock mechanism 144 described previously herein. In various embodiments, the latch arm 146 comprises a push button 147 disposed on an external side of the lid 121. In response to pressing the push button 147, the latch arm 146 is configured to engage lock jaw 310 of the lock mechanism 144. In this regard, to transition from the unlocked state 102 of FIG. 1B to the locked state 101 of FIG. 1A, the lid 121 can be closed (i.e., covering first longitudinal end 114 of the outer housing 110), and the push button 147 pressed, causing the push button 147 to activate the lock jaw 310 of the lock mechanism 144, which causes the lock jaw 310 to engage the latch arm 146, in accordance with various embodiments. In various embodiments, as described previously herein, to transition back from the locked state 101 of FIG. 1A to the unlocked state 102 of FIG. 1B, the sensor 141 is configured to provide a signal (e.g., a wired or wireless signal) to the lock mechanism 144 to automatically release the lock jaw 310, which releases the lid 121 of the door assembly 120.

In various embodiments, the latch arm 146 comprises an aperture 145 disposed therein. In various embodiments, a lock jaw 310 of the lock mechanism 144 is configured to engage the aperture 145 in a locked state 101 from FIG. 1A. In this regard, engagement between the lock mechanism 144 and the aperture of the latch arm 146 can prevent lid 121 from opening while transporting the gun safe assembly 100 as described previously herein.

Figure 3:
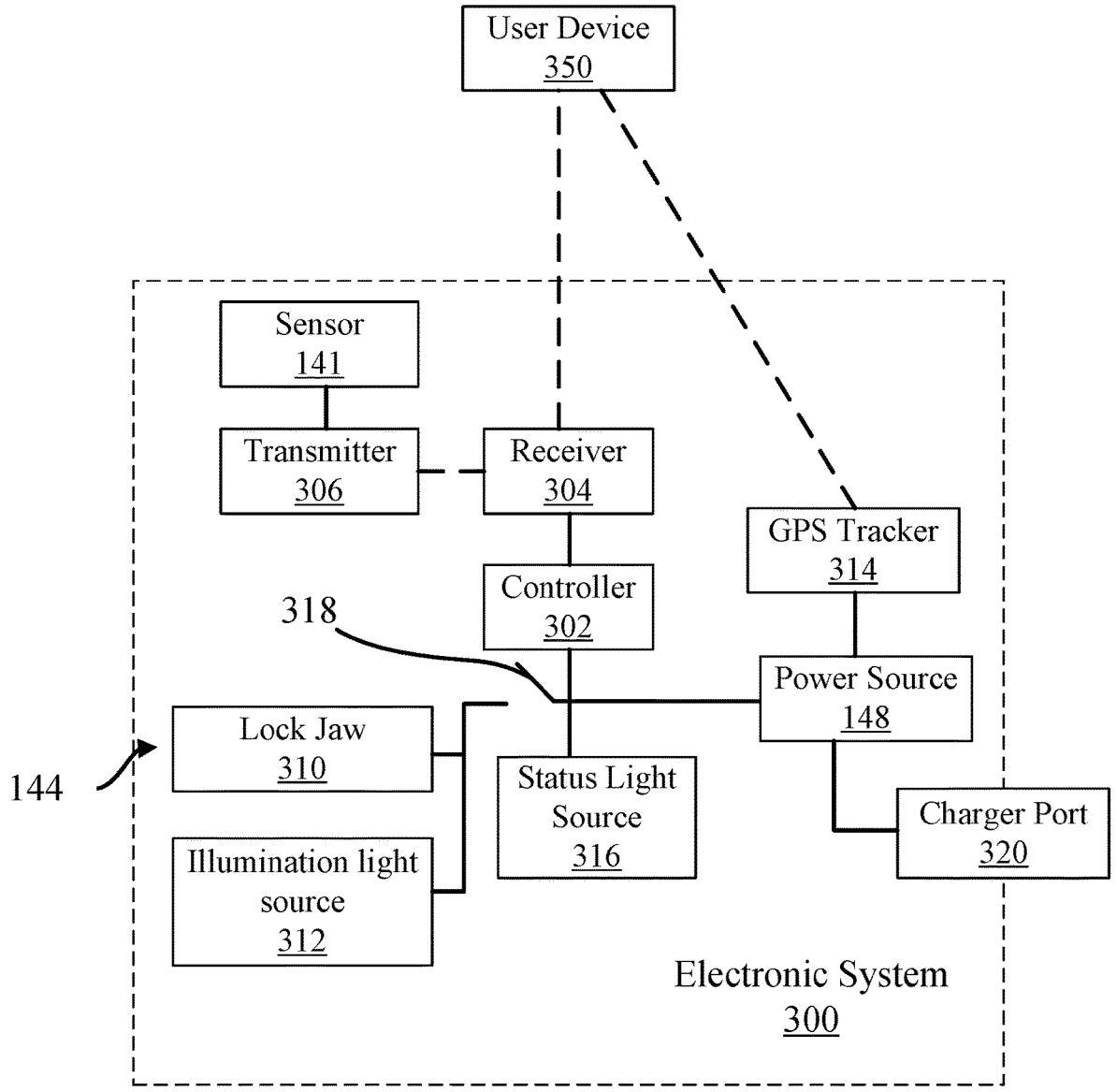
FIG. 3 illustrates a schematic view of an electronic system of a gun safe assembly, in accordance with various embodiments.

Referring now to FIG. 3, a schematic view of an electronic system 300 for the gun safe assembly 100 is illustrated, in accordance with various embodiments. In various embodiments, the electronic system 300 comprises a controller 302, the sensor 141, and the power source 148. In various embodiments, the controller 302 is installed on the PCB 149 of the gun safe assembly 100 as shown in FIGS. 2A-B.

In various embodiments, controller 302 may be configured as a central network element or hub to access various systems and components of electronic system 300. In various embodiments, controller 302 may comprise a processor. In various embodiments, controller 302 may be implemented in a single processor. In various embodiments, controller 302 may be implemented as and may include one or more processors and/or one or more tangible, non-transitory memories (e.g., memory) and be capable of implementing logic. Each processor can be a general-purpose processor, a digital signal processor ("DSP"), an application specific integrated circuit ("ASIC"), a field programmable gate array ("FPGA") or other programmable logic device, discrete gate or transistor logic, discrete hardware components, or any combination thereof. Controller 302 may comprise a processor configured to implement various logical operations in response to execution of instructions, for example, instructions stored on a non-transitory, tangible, computer-readable medium configured to communicate with controller 302.

System program instructions and/or controller instructions may be loaded onto a non-transitory, tangible computer-readable medium having instructions stored thereon that, in response to execution by a controller, cause the controller to perform various operations. The term "non-transitory" is to be understood to remove only propagating transitory signals per se from the claim scope and does not relinquish rights to all standard computer-readable media that are not only propagating transitory signals per se. Stated another way, the meaning of the term "non-transitory computer-readable medium" and "non-transitory computer-readable storage medium" should be construed to exclude only those types of transitory computer-readable media which were found in In Re Nuijten to fall outside the scope of patentable subject matter under 35 U.S.C. § 101.

In various embodiments, the electronic system 300 further comprises a transmitter 306 and a receiver 304. The transmitter 306 can be in electrical communication with the sensor 141, and the receiver 304 can be in electrical communication with the controller 302. In various embodiments, the transmitter 306 and the sensor 141 can be integrated as a single component. In various embodiments, the transmitter 306 and the sensor 141 can be separate distinct components. The present disclosure is not limited in this regard. In various embodiments, the transmitter 306 is a part of a transceiver. Similarly, in various embodiments, the receiver 304 can be a component of a transceiver. The present disclosure is not limited in this regard.

In various embodiments, the sensor 141 is in electronic communication (e.g., wireless or wired communication) with the controller 302. Although illustrated as communicating with the controller 302 through a transmitter 306 to a receiver 304, the present disclosure is not limited in this regard. For example, the sensor 141 could have a direct wire connection to the controller 302 and be within the scope of this disclosure.

In various embodiments, the sensor 141 is an RFID sensor 142 as described previously herein. In various embodiments, the electronic system 300 further comprises the lock jaw 310 of the lock mechanism 144. In various embodiments, in response to the sensor 141 receiving a sensor input (e.g., detecting an RFID tag associated with the RFID sensor 142), the sensor 141 sends a signal through the transmitter 306 to the receiver 304, which can be disposed in the PCB 149 for example, which relays the signal to the controller 302. In various embodiments, in response to receiving the signal from the sensor 141, the controller 302 can activate an electrical switch 318 (e.g., to close the electrical switch 318 and electrically couple the power source 148 to the lock jaw 310 of the lock mechanism 144. In this regard, in response to receiving a current from the power source 148, the lock jaw 310 is configured to actuate from an engaged state (e.g., engaged with the aperture of the latch arm 146) to a disengaged state (or retracted state), allowing the latch arm 146 to disengage and the lid 121 to open as described previously herein. Although described as being in electrical communication with the lock jaw 310, the present disclosure is not limited in this regard. For example, the lock jaw 310 can comprise an electrical component configured to receive the electrical input and actuate the lock jaw 310 accordingly, the lock jaw 310 need not receive the current directly to be within the scope of this disclosure. Although described herein as comprising an electrical switch 318, the present disclosure is not limited in this regard. For example, any electromechanical device configured to receive a command and actuate the lock jaw 310 in response to receiving the command is within the scope of this disclosure.

In various embodiments, the electronic system 300 comprises an illumination light source 312 (e.g., an illumination light emitting diode ("LED"), an incandescent bulb, or the like). In various embodiments, the illumination light source 312 is coupled to the inner housing assembly 160 of the gun safe assembly 100. For example, the illumination light source 312 can be configured to provide emit light (e.g., emit an electromagnetic radiation), in response to the controller 302 closing the electrical switch 318. In this regard, the illumination light source 312 can be configured to automatically illuminate the gun storage cavity 105 of the gun safe assembly 100 in response to the gun safe assembly 100 transitioning to an open state 104 and unlocked state 102 as described previously herein.

In various embodiments, the electronic system 300 further comprises a GPS tracker 314. Although described herein as comprising the GPS tracker 314 in the electronic system 300, it may be desirable to not include a GPS tracker 314 in the gun safe assembly for reasons described previously herein. For example, electrical circuits for GPS systems of a GPS tracker 314 can be complex, add additional fault points to the electronic system 300, add weight, and/or add cost, in accordance with various embodiments. In this regard, as described previously herein, a tracker tag (e.g., an AirTag™ as sold by Apple, Inc., headquartered in Cupertino California, or any other tracker tag known in the art) can be purchased separately by a user and stored in the gun safe assembly (e.g., in the auxiliary storage system 170 of the gun safe assembly 100 from FIG. 1B). A "tracker tag" as referred to herein is a wireless communication device capable of locating, monitoring, and/or tracking a position of a position of the tracker tag.

The GPS tracker 314 can be in electronic (e.g., wireless or wired) communication with the controller 302. In this regard, the GPS tracker 314 can continuously monitor a location of the gun safe assembly 100 and a user can determine the location based on retrieving GPS data remotely from the GPS tracker 314 in response to the gun safe assembly 100 being stolen, or the like.

In various embodiments, the electronic system 300 further comprises a status light source 316. Although illustrated as a single status light source, any number of lights can be disposed in the status light source 316. In various embodiments, the status light source 316 can be configured to display a status of the power source 148 (i.e., whether the power source 148 is charged or needs charging). For example, the controller 302 can monitor a capacity of the power source 148 and send a signal to the status light source 316 in response to a capacity of the power source 148 dropping below a threshold level.

In various embodiments, the electronic system 300 further comprises a charger port 320 (e.g., a USB port or the like) in electrical communication with the power source 148. In this regard, the power source 148 can comprise a secondary battery (e.g., a rechargeable battery).

In various embodiments, the electronic system 300 further comprises an electronic device configured for short-range radio frequency communication (e.g., the receiver 304). In this regard, a user can access the electronic system 300 via a user device 350 (e.g., via a graphical user interface (GUI), or the like). In this regard, after pairing a user device 350 with the electronic system 300 of the gun safe assembly 100, a user can unlock the gun safe assembly 100 through Bluetooth® connectivity, or any other short-range radio frequency communication, through a GUI of a user device 350, in accordance with various embodiments.

Figure 4A:
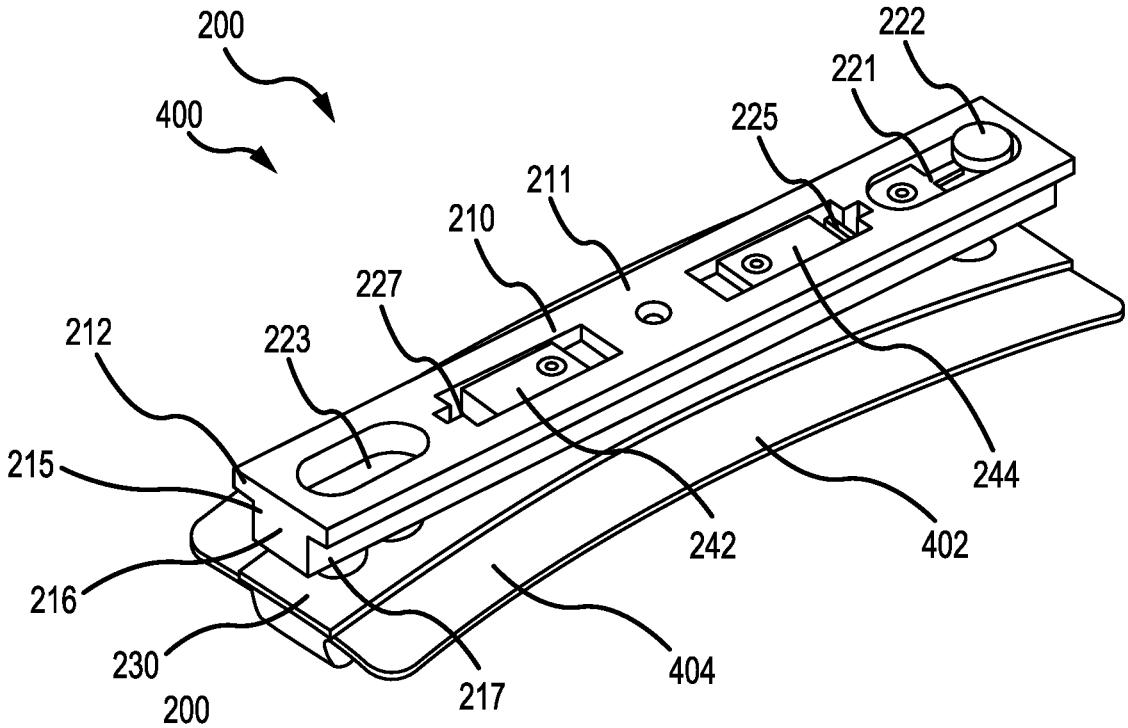
FIG. 4A illustrates a perspective view of a mount assembly in an installed state, in accordance with various embodiments.
Figure 4B:
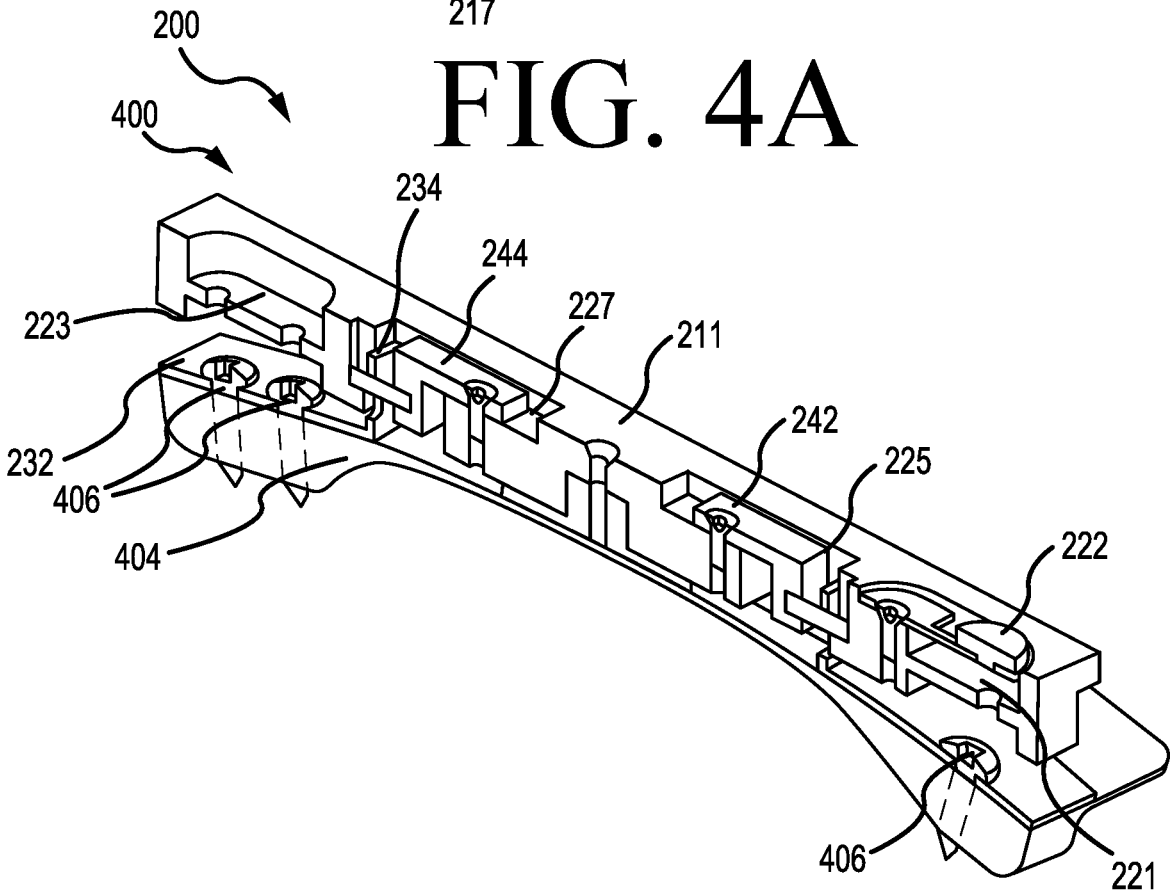
FIG. 4B illustrates a perspective cross-sectional view of a mount assembly in an installed state, in accordance with various embodiments.

Referring now to FIGS. 4A and 4B, a perspective view (FIG. 4A) and a cross-sectional perspective view (FIG. 4B) of the mount assembly 200 in an installed state 400 is illustrated, with like numerals depicting like elements, in accordance with various embodiments. An "installed state" as disclosed herein, refers to the mount assembly 200 being coupled to a support structure 402. In various embodiments, the support structure 402 can be a panel in a car, furniture, a desk, a wall, or the like. The present disclosure is not limited in this regard.

In various embodiments, the mount assembly 200 can facilitate installation on a curved surface, such as a panel in a car, or the like. For example, the mount assembly 200 can comprise a bracket 230 comprises a first mating flange 232 configured to be coupled to a support structure 402 (e.g., a car panel 404) and a second mating flange 234 configured to be coupled to the mounting rail 210 of the mount assembly 200. In various embodiments, the bracket 230 can be a monolithic component or the mount assembly 200 can comprise more than one of the bracket 230. The present disclosure is not limited in this regard.

In various embodiments, the mounting rail 210 comprises a flange 212 and a protrusion 216. The flange 212 and the protrusion 216 extend longitudinally from a first longitudinal end of the mounting rail 210 to a second longitudinal end of the mounting rail 210. The flange 212 and the protrusion 216 define a shoulder 215 on a first lateral side of the mounting rail 210 and a shoulder 217 on a second lateral side of the mounting rail 210. In various embodiments, the shoulders 215, 217 are configured to engage with a respective mounting rail guide (e.g., mounting rail guide 111, mounting rail guide 112, or mounting rail guide 113) of the gun safe assembly 100 as described previously herein. In various embodiments, by utilizing a mounting rail 210 that extends longitudinally in the manner disclosed herein, a force to break the mounting rail 210 off the support structure 402 while the gun safe assembly 100 is in a docked configuration 12 as shown in FIG. 1A is excessively large, preventing the gun safe assembly 100 from being dislodged from a support structure 402, in accordance with various embodiments.

In various embodiments, the push button 222 of the mount assembly 200 can be biased outward from a longitudinal mating surface 211 of the mounting rail 210 via any biasing mechanism (e.g., a compression spring, a torsion spring, or the like). The present disclosure is not limited in this regard.

In various embodiments, the mounting rail 210 comprises a first vertical aperture 221 disposed proximate a first longitudinal end of the mounting rail 210 and a second vertical aperture 223 deposed proximate a second longitudinal end of the mounting rail 210. The vertical apertures 221, 223 can facilitate tool access for coupling the bracket 230 to the support structure 402. In this regard, a tool can be disposed through a respective aperture to couple the bracket 230 to the support structure 402 via fasteners 406. Although alternative coupling mechanisms, such as adhesives or the like, could be used, fasteners 406 can facilitate a stronger coupling and provide an easier assembly for a user relative to other coupling means, in accordance with various embodiments.

In various embodiments, the mount assembly 200 comprises retainers 242, 244. The retainers 242, 244 are configured to facilitate installation of the mount assembly 200 on the support structure 402. For example, after coupling the bracket 230 to the support structure 402, then mounting the flange 234 of the bracket 230 can be disposed through mounting apertures 225, 227, the retainers 242, 244 can be placed in the mounting apertures 225, 227, a protrusion of each retainer 242, 244, can extend through an aperture of a respective flange 234, and secure the flange 234 relative to the retainer 242, 244. Then, the retainer 242, 244, can be coupled to the mounting rail 210 via a fastener or any other coupling means, in accordance with various embodiments.

Figure 5B:
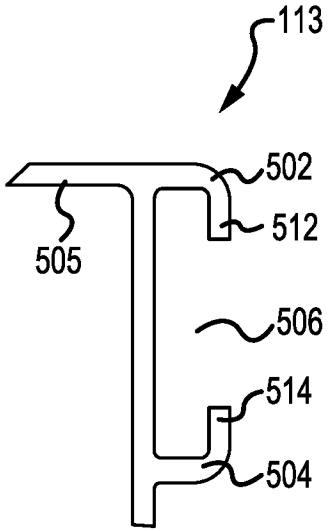
FIG. 5B illustrates a detail view of a mounting rail guide of an outer enclosure of a gun safe assembly, in accordance with various embodiments.
Figure 5A:
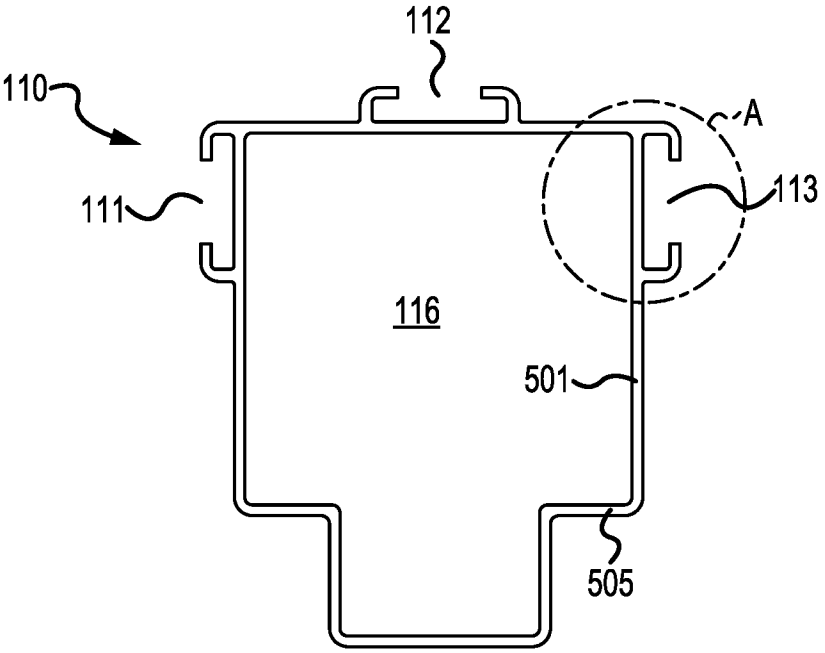
FIG. 5A illustrates a front view of an outer enclosure of a gun safe assembly, in accordance with various embodiments.

Referring now to FIG. 5A, a front view of the outer housing 110 is illustrated, in accordance with various embodiments, with like numerals depicting like elements. An internal surface 501 of the outer housing 110 defines the hollow channel 116. Referring now to FIG. 5B, a detail view (Detail A) of a mounting rail guide (e.g., mounting rail guide 113) is illustrated in accordance with various embodiments. As described previously herein, the mounting rail guide 113 is configured to receive a mounting rail (e.g., mounting rail 210 of mount assembly 200). In this regard, the mounting rail guide 113 comprises a first wall 502 and a second wall 504. The first wall 502 extends outward from a housing main body 505 of the outer housing 110. Similarly, the second wall 504 extends outward from the housing main body 505. The first wall 502 comprises a lip 512. Similarly, the second wall 504 comprises a lip 514. The first wall 502, the second wall 504, and a portion of the housing main body 505 define a groove 506 therein. In this regard, the groove of the mounting rail guide 113 is configured to receive the mounting rail (e.g., mounting rail 210 of the mount assembly 200).

Figure 6A:
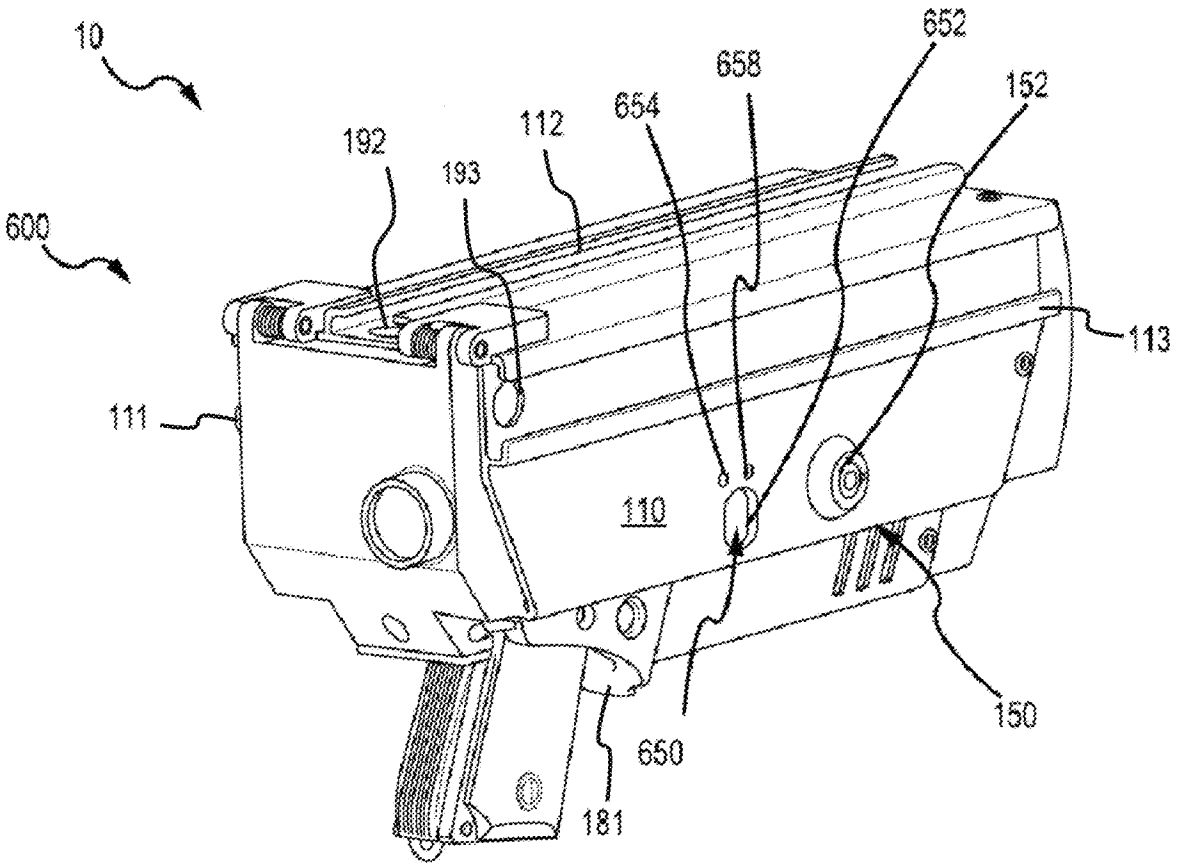
FIG. 6A illustrates a perspective view of a gun safety system in a docked configuration, in accordance with various embodiments.

Referring now to FIG. 6A, a perspective view of the gun safety system 10 with a gun safe assembly 600 and the mount assembly 200, is illustrated with like numerals depicting like elements, in accordance with various embodiments. In various embodiments, the gun safe assembly 600 is in accordance with the gun safe assembly 100 described previously herein, and further comprises a programmable lock mechanism 650. In various embodiments, the programmable lock mechanism 650 can be in addition to the key switch 152 or replace the key switch 152. The present disclosure is not limited in this regard. In this regard, the override locking system 150 can include a key switch 152 and/or a programmable lock mechanism 650.

In various embodiments, the programmable lock mechanism 650 includes a main button 652 and a setup button 654. Although illustrated with a setup button 654, the present disclosure is not limited in this regard. For example, the programmable lock mechanism 650 can include only the main button 652 and can be programmable through a user interface (UI) on a user device 350 as described further herein and still be within the scope of this disclosure. A "button" (e.g., main button 652 and setup button 654), as referred to herein, can comprise any apparatus that is configured to initiate an electrical response in the lock mechanism 650. For example, the main button 652 and the setup button 654 can each comprise a sensor (e.g., a contact sensor, a pressure sensor, a piezoelectric sensor, etc.), a mechanical push button that contacts, or physically communicates with, a sensor, or the like is within the scope of this disclosure. In this regard, the buttons (e.g., main button 652 and/or setup button 654) can comprise physical buttons or virtual buttons (i.e., a sensor or the like) that communicates with a controller as described further herein, in accordance with various embodiments.

In various embodiments, the programmable lock mechanism 650 can further comprise an indicator 658 (e.g., a light, a speaker, or the like). In various embodiments, the indicator 658 can be configured to provide an indication to a user that a unique passcode can be set (i.e., during programing of the programmable lock mechanism 650). For example, the indicator 658 can comprise a light configured to flash, a speaker configured to make a sound, multiple lights configured to display different colors based on a status of the programmable lock mechanism 650, or the like. The present disclosure is not limited in this regard. Any device capable of providing a user with an indication that a following sequence will be a unique passcode, a status of the programmable lock mechanism 650 (e.g., a locked state or an unlocked state), or the like is within the scope of this disclosure. Although illustrated as comprising an indicator 658, the present disclosure is not limited in this regard. For example, the programmable lock mechanism 650 may not include an indicator 658 and still be within the scope of this disclosure.

Figure 6B:
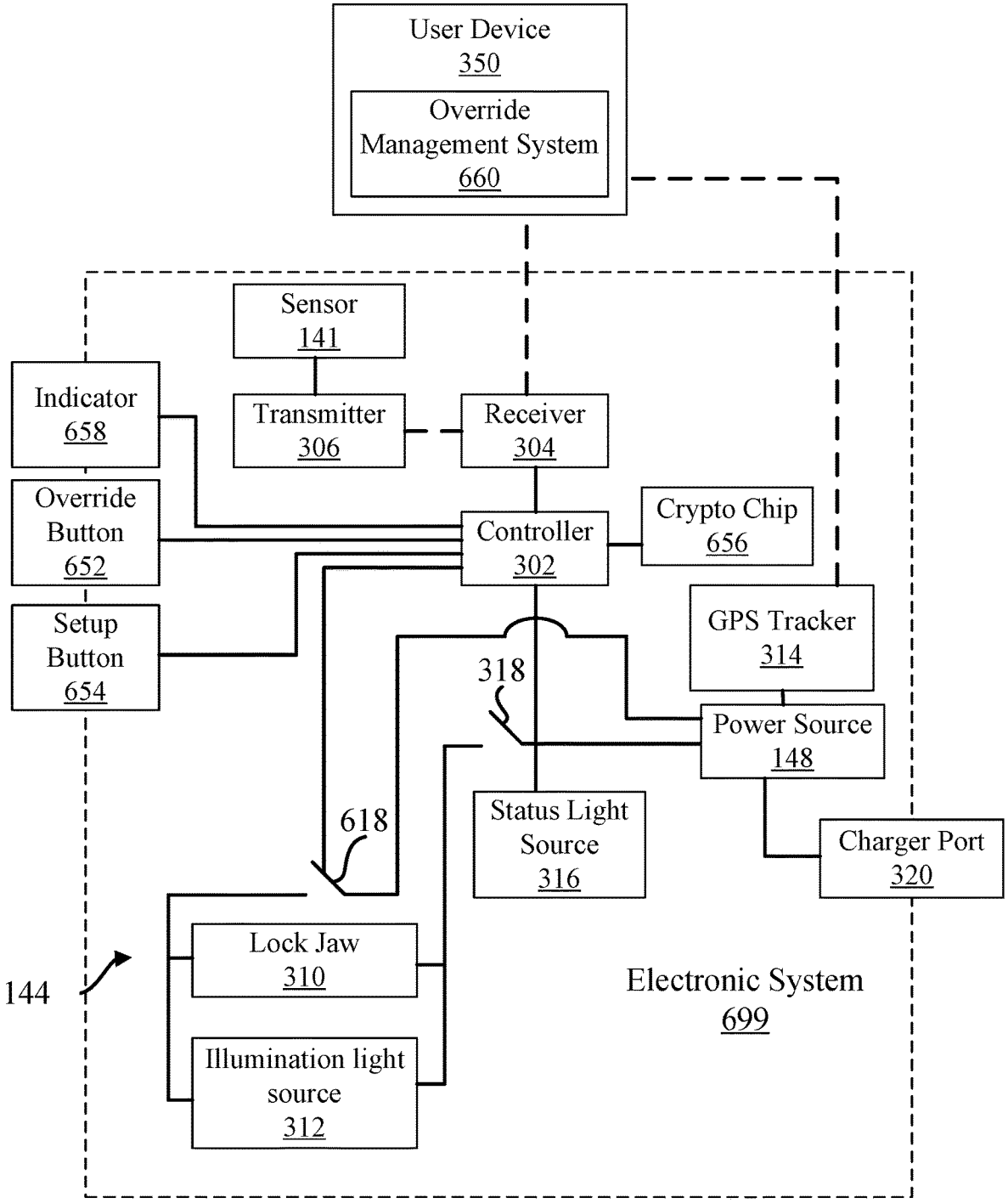
FIG. 6B illustrates a schematic view of an electronic system of a gun safe assembly, in accordance with various embodiments.

Referring now to FIG. 6B, a schematic view of an electronic system 699 of the gun safe assembly 600 from FIG. 6A is illustrated, in accordance with various embodiments. In various embodiments, the electronic system 699 further comprises a second electrical switch (e.g., electrical switch 618) in electrical communication with the controller 302. Although described herein as comprising an electrical switch 618, the present disclosure is not limited in this regard. For example, any electromechanical device configured to receive a command, where the lock jaw 310 is actuated in response to the electromechanical device receiving the command, is within the scope of this disclosure.

In various embodiments, the electrical switch 618 is disposed electrically between the power source 148 and the lock jaw 310 of the lock mechanism 144. In various embodiments, the electrical switch 618 is disposed within an independent electrical circuit relative to the electrical switch 318. In this regard, the electrical switch 618 can be commanded to transition from an open position to closed position in a situation where the electronic locking system 140 is not working (or if an RFID tag for the electronic locking system 140 is lost).

In various embodiments, the controller 302 is in electrical communication with the main button 652, the setup button 654, a crypto chip 656, and/or the indicator 658. A "crypto chip" as referred to herein is a secure crypto processor. The crypto chip 656 can be a dedicated computer-on-a-chip or microprocessor for carrying out cryptographic operations as described further herein.

Figure 7:
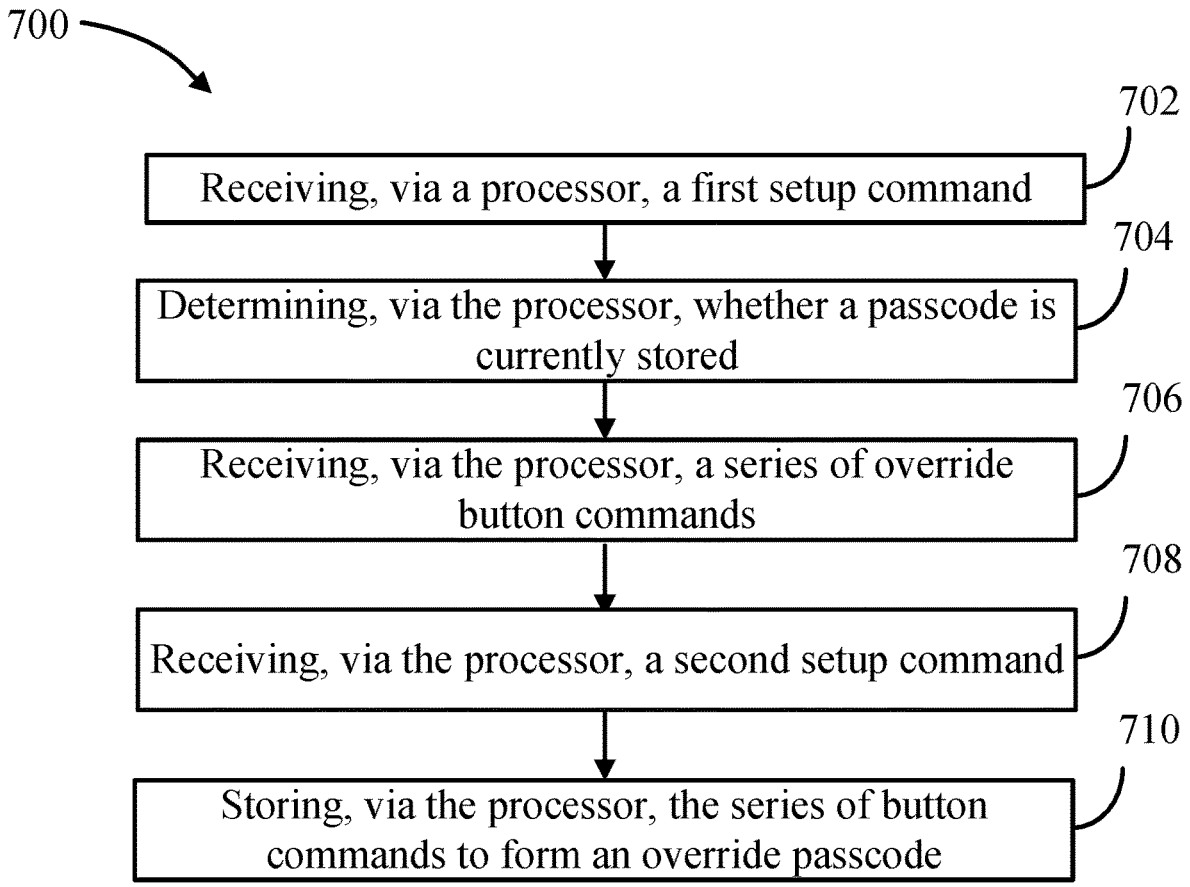
FIG. 7 illustrates a process for operating a programmable lock mechanism of an electronic system of a gun safe assembly, in accordance with various embodiments.

Referring now to FIG. 7, a process 700 (FIG. 7) for setting up a programmable lock mechanism 650 of a gun safe assembly 600 from FIG. 6A with an electronic system 699 of FIG. 6B is illustrated, in accordance with various embodiments. With combined reference to FIGS. 6A, 6B, and 7, the process 700 can comprise receiving, via a processor (e.g., controller 302), a first setup command (step 702). In various embodiments, the first setup command can comprise pressing a setup button 654 (or the main button 652) of the programmable lock mechanism 650 for a threshold period of time (e.g., three seconds, five seconds, or the like). In various embodiments, the first setup command can comprise pressing the setup button 654 in a predetermined sequence (e.g., three times or the like). The present disclosure is not limited in this regard. "Pressing," as referred to herein, can include physically depressing a button, touching a surface for a period of time, or the like depending on a type of button (e.g., a physical button or a virtual button), in accordance with various embodiments. The present disclosure is not limited in this regard.

In various embodiments, the process 700 further comprises determining, via the processor, whether a passcode is currently stored (step 704). In various embodiments, the programmable lock mechanism 650 can be configured for a single passcode. In this regard, in response to processor determining that a passcode already exists, the processor can send a command to the indicator 658 to indicate that a passcode already exists (e.g., a red light, a specific sound, or the like) and the process 700 can end. In various embodiments, in response to determining that a passcode is not currently being stored (i.e., a passcode has not been setup), the processor can send a command to the indicator 658 to indicate to a user that the user can enter an override passcode. Although described herein as including step 704, the present disclosure is not limited in this regard. For example, a programmable lock mechanism 650 that is capable of storing a plurality of passcodes is within the scope of this disclosure, as described further herein.

In various embodiments, the process 700 further comprises receiving, via the processor, a series of override button commands (step 706). In various embodiments, the series of override button commands can include any of the following parameters: a pressed duration for each button push and a time lapse between each button push. In various embodiments, the series of override button commands includes only a time lapse between button pushes. However, the present disclosure is not limited in this regard.

In various embodiments, the process 700 further comprises receiving, via the processor, a second setup command (step 708). In this regard, the first setup command from step 702 and the second setup command from step 708 can define a beginning and ending point for setting up the override passcode. For example, in response to determining that a passcode is not currently set up in step 704, after the first setup command step 702 is received, the processer is configured to read a first button push in the series of override button commands as a first button push of the override passcode formed from process 700, as described further herein.

For example, in an exemplary embodiment, a user presses the setup button 654 button for a threshold period of time in step 702. In response to pressing the setup button 654 for the threshold period of time, the indicator 658 begins to flash. The flashing of the indicator 658 indicates to the user that the passcode can now be set. The user can then enter a passcode. For example, the user can enter a passcode corresponding to a jingle (e.g., three pulses each within a half second of each other followed by three pulses within a half second of each other, and a gap of approximately two seconds between the first three pulses and the second three pulses). After entering the passcode, the user can press the setup button 654 again. In response to pressing the setup button 654 again, the indicator 658 can stop flashing, or display a green color, or the like. In this regard, the user can be notified that the passcode has been accepted by the electronic system 699. In various embodiments, a time lapse between button pushes for the main button 652 associated with the passcode can have a predetermined tolerance. For example, the time lapse can have a tolerance of +/−10%, or +/−20% from a time lapse entered during the setup phase. In this regard, the passcode may allow some flexibility in determining whether an entered passcode matches the passcode for future uses. In response to setting up the programmable lock mechanism 650 as described herein, the user can lock and unlock the gun safe assembly 600 by entering the passcode via the main button 652, in accordance with various embodiments.

In various embodiments, the process 700 further comprises storing, via the processor, the series of button commands to form the override passcode (step 710). In this regard, the override passcode can comprise a series of button pushes (i.e., of main button 652) with a pre-set time lapse between button pushes (i.e., from step 706 of process 700).

Although illustrated as comprising a manual process for generating an override passcode in process 700, the present disclosure is not limited in this regard. For example, as described further herein, a setup button 654 (as shown in FIGS. 6A and 6B) can potentially be eliminated, in accordance with various embodiments, and an override passcode generation process (e.g., process 800 from FIG. 8) can be facilitated electronically, through an override management system 660 on a user device 350 from FIG. 6B.

Figure 8:
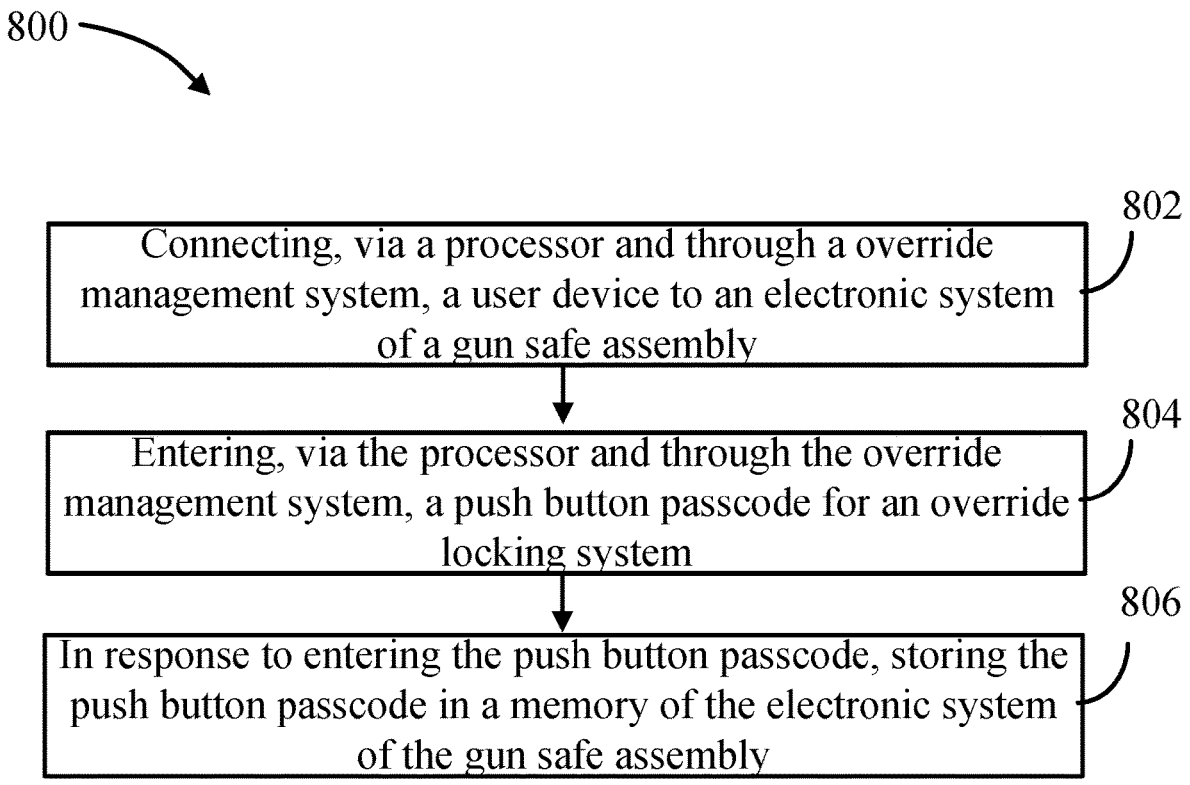
FIG. 8 illustrates a process for operating a programmable lock mechanism of an electronic system of a gun safe assembly, in accordance with various embodiments.

Referring now to FIG. 8, a process 800 for generating an override passcode for a gun safe assembly 600 electronically (e.g., through override management system 660 of a user device 350 from FIG. 6B), is illustrated, in accordance with various embodiments. With combined reference to FIGS. 6A, 6B, and 8, in various embodiments, the process 800 comprises connecting, via a processor and through an override management system 660, a user device 350 to an electronic system 699 of the gun safe assembly 600 (step 802). In various embodiments, the connecting of step 802 can be through a short-range wireless interconnection (e.g., Bluetooth, or the like). In this regard, short range wireless interconnection, such as Bluetooth can connect the override management system 660 to the controller 302 of the electronic system 699 (e.g., through receiver 304 or the like).

In various embodiments, components, modules, and/or engines of the override management system 660 may be implemented as micro-applications or micro-apps. Micro-apps are typically deployed in the context of a mobile operating system, including for example, a Palm mobile operating system, a Windows mobile operating system, an Android operating system, Apple iOS, a Blackberry operating system, and the like. The micro-app may be configured to leverage the resources of the larger operating system and associated hardware via a set of predetermined rules which govern the operations of various operating systems and hardware resources. For example, where a micro-app desires to communicate with a device or network other than the mobile device or mobile operating system, the micro-app may leverage the communication protocol of the operating system and associated device hardware under the predetermined rules of the mobile operating system. Moreover, where the micro-app desires an input from a user, the micro-app may be configured to request a response from the operating system which monitors various hardware components and then communicates a detected input from the hardware to the micro-app.

In accordance with various embodiments, override management system 660 is usable to: register an account associated with a gun safe assembly 100; provide consumers access to override passcodes for the programmable lock mechanism 650 of the gun safe assembly 600; generate override passcodes for the programmable lock mechanism 650 of the gun safe assembly 600, view current passcodes for the gun safe assembly (e.g., as a button lighting up in a sequence associated with the passcode through the user device 350 or the like), etc. The present disclosure is not limited in this regard.

In various embodiments, the process 800 further comprises entering, via the processor and through the override management system 660 a push button passcode for an override locking system 150 (e.g., programmable lock mechanism 650) (step 804). For example, with brief reference to FIGS. 9A and 9B, the override management system 660 can comprise a graphical user interface ("GUI") configured to be displayed on a user device 350. In various embodiments, the GUI 662, can display a virtual button (e.g., button 664) and a message (e.g., message 665) during process 800 from FIG. 8. In various embodiments, the message 665 can facilitate a user action for entering a new passcode for the programmable lock mechanism 650 from FIGS. 6A and 6B. Although illustrated as stating press button to start, the present disclosure is not limited in this regard. For example, a separate button (e.g., a start button) could be utilized, no message could be provided, or the like.

Figure 9B:
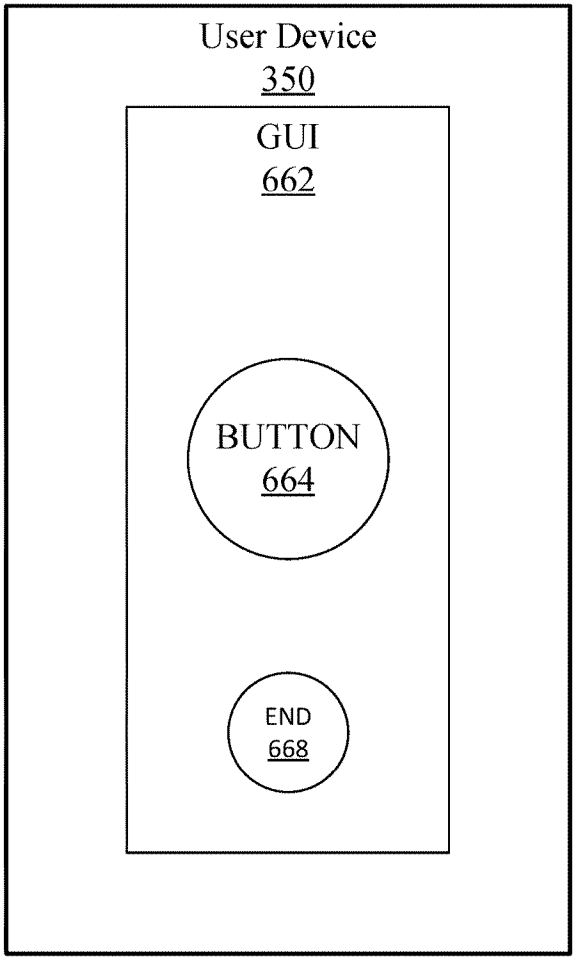
FIG. 9B illustrates an override management system on a user device during operation of the override management system, in accordance with various embodiments.

In various embodiments, in response to pressing the button 664, via the GUI 662, the override management system 660 can begin storing a passcode for use with the programmable lock mechanism 650 (step 806). In various embodiments, the override management system 660 can transmit the passcode as the passcode is being entered, or record the passcode and transmit a newly formed passcode upon completion of step 804 of process 800. The present disclosure is not limited in this regard. In various embodiments, as shown in FIG. 9B, an end button (e.g., end button 668) can appear through the GUI 662 after passcode generation process (e.g., step 804 of process 800) has been initiated. In this regard, after a user is satisfied with a series of buttons for the passcode of the programmable lock mechanism 650, the user can press the end button 668 and a new passcode can be generated. In various embodiments, a user may have an option to accept the new passcode after performing step 804 of process 800. For example, if a user makes a mistake, or wants to make a new passcode, a user can delete the passcode and repeat the above process, in accordance with various embodiments.

Figure 9A:
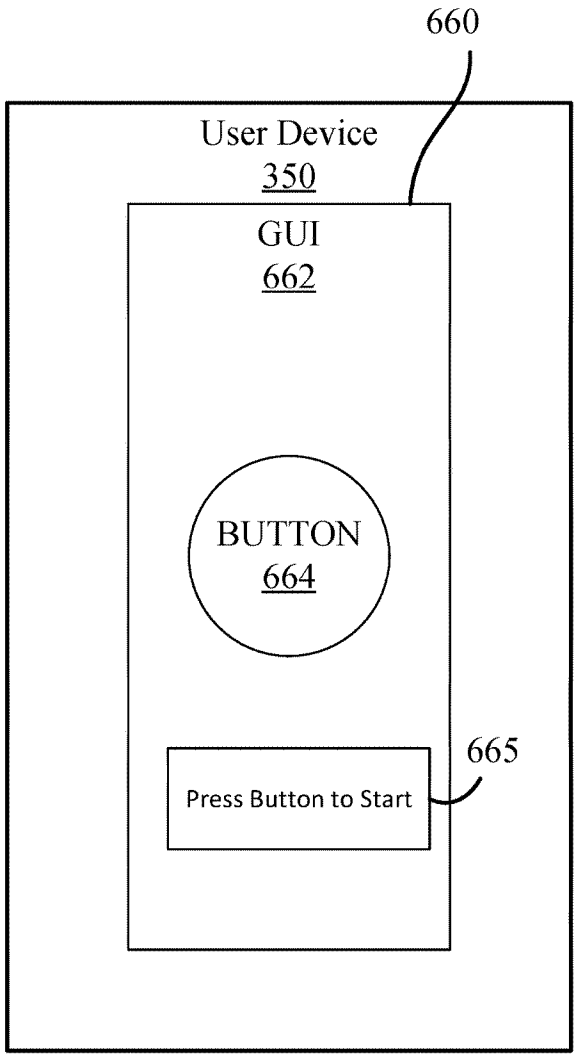
FIG. 9A illustrates an override management system on a user device during operation of the override management system, in accordance with various embodiments.

FIGS. 9A and 9B are illustrated purely for exemplary purposes and are not meant to be limiting in any regard with respect to the override management system 660. For example, various types of GUI's can be envisioned by one skilled in the art to generate a push button passcode and still be within the scope of this disclosure.

Figure 10:
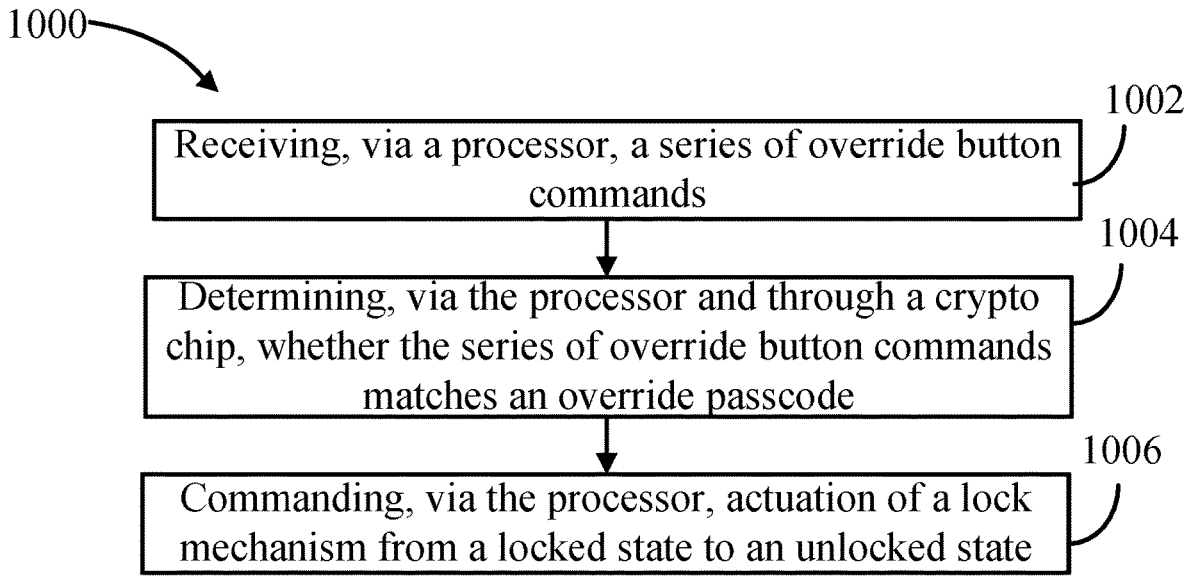
FIG. 10 illustrates a process for operating a programmable lock mechanism of an electronic system of a gun safe assembly, in accordance with various embodiment.

Referring now to FIG. 10, a process 1000 for unlocking the gun safe assembly 600 from FIGS. 6A and 6B, via the programmable lock mechanism 650 is illustrated, in accordance with various embodiments. With combined reference to FIGS. 6A, 6B, and 7, the process 1000 comprises receiving, via a processor (e.g., controller 302), a series of override button commands (e.g., main button 652 being pressed in a sequence of presses as described previously herein) (step 1002).

The process 1000 further comprises determining, via the processor and through a crypto chip 656, whether the series of override button commands matches an override passcode (step 1004). For example, in response to performing process 800 from FIG. 8 or process 700 from FIG. 7, an override passcode is stored in a memory of the electronic system 699 (e.g., a memory of controller 302 or a memory of the crypto chip 656). In this regard, the controller 302 can send the override button commands to the crypto chip 656, the crypto chip 656 can compare the series of override button commands to the override passcode, and the crypto chip 656 can send to the controller 302 whether the series of override button commands matches the override passcode.

In various embodiments, in response to the series of override button commands matching the override passcode, the process 1000 further comprises commanding, via the processor, actuation of a lock mechanism 144 from a locked state to an unlocked state (step 1006). In this regard, in response to the command in step 1006, the lock jaw 310 of the lock mechanism 144 can be actuated from an engaged position to a disengaged position. In response to being in a disengaged position, the door assembly 120 can be transitioned from a closed state 103 to an open state 104 as described previously herein.

Figure 11:
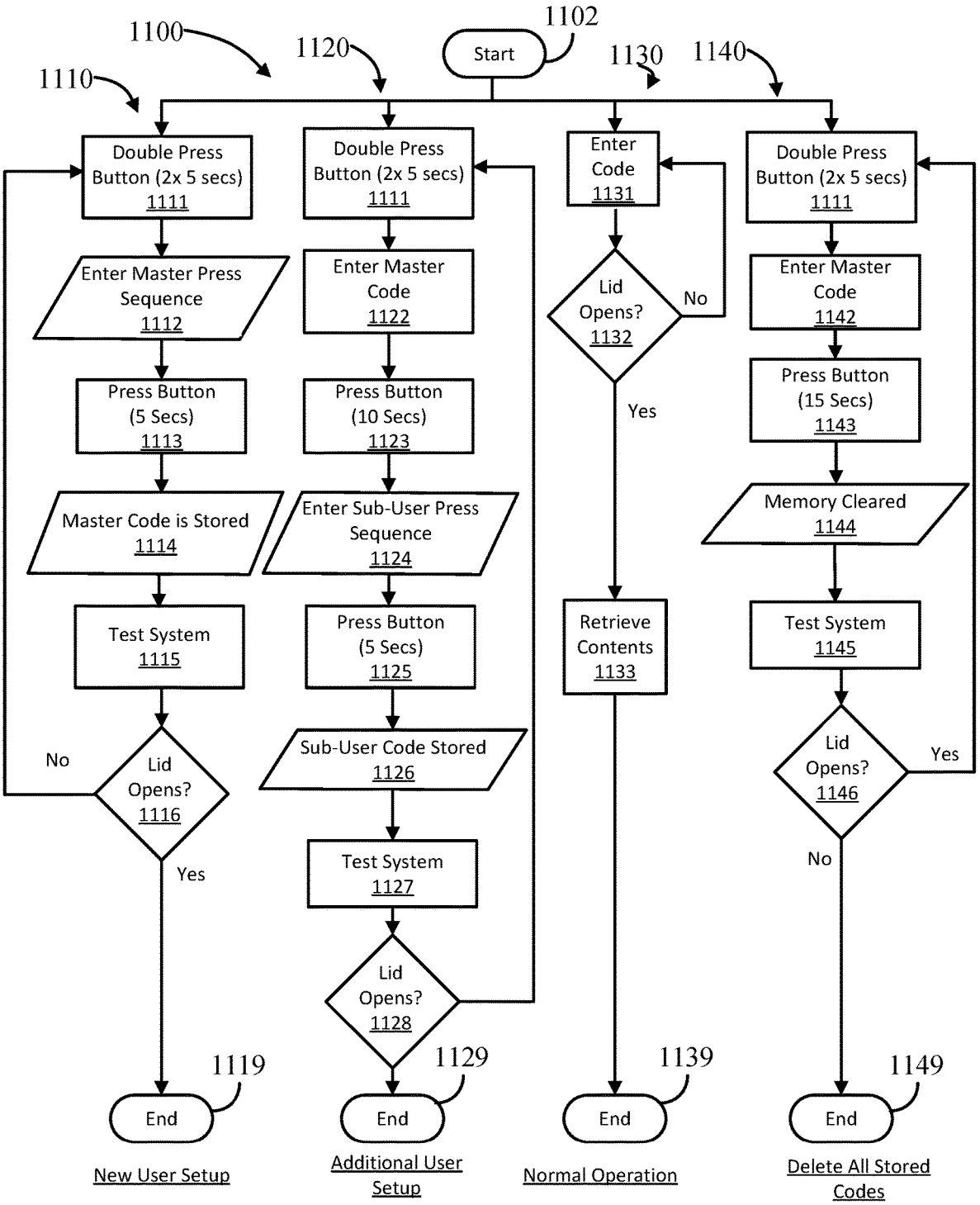
FIG. 11 illustrates a process for operating a programmable lock mechanism of an electronic system of a gun safe assembly, in accordance with various embodiment.

Referring now to FIG. 11, a process 1100, from a user's perspective, is illustrated with exemplary parameters, in accordance with various embodiments. The details provided in the process 1100 are provided for illustrative purposes only and are not meant to be limiting in any manner. The process 1100 starts in block 1102 and is followed by a sub-process (e.g., process 1110 for a new user setup, process 1120 for an additional user setup, process 1130 for normal operation, or process 1140 to delete all stored codes). In various embodiments, process 1110 can correspond to process 700 from FIG. 7. In various embodiments, process 1130 can correspond to process 1000 from FIG. 10. In this regard, process 1110 can be similar to process 700 but from the user's perspective, and process 1130 can be similar to process 1000 but from the user's perspective, in accordance with various embodiments.

In various embodiments, the process 1110 for a new user setup can comprise entering a first setup command in accordance with step 702 for process 700 from FIG. 7. For example, a first setup command can comprise double pressing a button (e.g., main button 652 or setup button 654) each press corresponding to a pre-determined duration (e.g., 5 seconds) (block 1111). In various embodiments, the programmable lock mechanism 650 can comprise various tolerances for the pre-determined duration (e.g., +/−0.5 seconds, +/−1 second, +/−2 seconds, or the like). In this regard, as long as a user is within the tolerances of the pre-determined duration for both presses, the programmable lock mechanism 650 can recognize that the setup command from step 702 from process 700 was received from the user in block 1111 of process 1110. As described previously herein, the programmable lock mechanism 650 can comprise the main button 652 only or the main button 652 and the setup button 654. The present disclosure is not limited in this regard.

In various embodiments, the process 1110 for a new user setup can further comprise entering a master press sequence as described previously herein (e.g., in accordance with step 706 of process 700). In this regard, the user can define a master press sequence that controls the programmable lock mechanism 650, in accordance with various embodiments. After entering the master press sequence in block 1112, the process 1110 can further comprise entering a second setup command in accordance with step 708 of process 700. The second setup command can comprise pressing a button (e.g., main button 652 or setup button 654) for a pre-determined duration (e.g., 5 seconds) (block 1113). In response to receiving the second setup command in block 1113, the master press sequence from block 1112 can be stored as described previously herein in step 710 of process 700 (block 1114).

After creating a master code in blocks 1111-1114, the process 1110 can further comprise testing the programmable lock mechanism 650 from FIGS. 6A-B (block 1115). In various embodiments, testing the system in block 1115 can comprise performing process 1130 as described further herein. In this regard, in response to entering the master passcode that was generated in blocks 1111-1114, a user can test to see if the lid 121 of the door assembly 120 opens in block 1116. If the lid 121 opens, then the user knows that the master code has been properly set and the process ends at block 1119. If the lid 121 does not open, the user can repeat process 1110 to ensure the master code is properly generated.

In various embodiments, the programmable lock mechanism 650 from FIGS. 6A-B can be configured to setup additional passcodes in accordance with process 1120. In various embodiments, the process 1120 can comprise entering the first setup command in block 1111 (e.g., double pressing one of the setup button 654 or the main button 652 for the pre-determined duration). The process 1120 can comprise entering the master passcode that was set up in the process 1110 (block 1122). In various embodiments, the process 1120 further comprises entering a second setup command (e.g., pressing one of the setup button 654 or the main button 652 for a pre-determined duration) (block 1123). In various embodiments the second setup command can be the same as the setup command in block 1113 of process 1110 (e.g., pressing a button for 5 seconds) or different from the second setup command in block 1113 of process 1110 (e.g., pressing a button for 10 seconds). The present disclosure is not limited in this regard.

In various embodiments, the process 1120 can further comprise entering a sub-user press sequence (e.g., a second pass code that is different from the master pass code generated from process 1110) (block 1124). In this regard, any number of sub-user passcodes can be generated by the process 1120. In various embodiments, a number of sub-user passcodes can be limited (e.g., five sub-user passcodes, ten sub-user passcodes, or the like). The present disclosure is not limited in this regard. In various embodiments, the process 1120 further comprises entering a third setup command (e.g., pressing one of the setup button 654 or the main button 652 for a pre-determined duration) (block 1125). In various embodiments, in response to entering the third setup command in block 1125, the sub-user code is stored as described previously herein in step 710 of process 700 (block 1126).

Similar to process 1110, the sub-user passcode can be tested in block 1127, and if the lid 121 opens in block 1128, the user will know that the sub-user passcode has been stored properly and can be used in the future and the process 1120 ends at block 1129). If the lid 121 does not open in block 1128, the process 1120 can be repeated in order to generate the sub-user passcode, in accordance with various embodiments.

In various embodiments, the process 1130 is for normal operation of the programmable lock mechanism 650 from FIGS. 6A-B. For example, a passcode that was generated in process 1110 or process 1120 (e.g., a master passcode or a sub-user passcode) can be entered by a user in block 1131. In response to the user entering the passcode, the programmable lock mechanism performs the process 1000 from FIG. 10. In this regard, the processor receives the series of override button commands (step 1002), the processor determines whether the series of override button commands matches an override passcode (e.g., a master passcode or a sub-user passcode) (step 1004), and the processor commands actuation of a lock mechanism from a locked state to an unlocked state in response to the override button commands matching the override passcode (step 1006). In this regard, in response to actuation of the lock mechanism in step 1006 of the process 1000, the lid 121 opens in block 1132. If the override button commands do not match an override passcode in step 1004 of process 1000, the lid 121 does not open in block 1132 and a user can re-enter a code in block 1131. In response to the lid 121 opening in block 1132, a user can retrieve the contents from within the gun safe assembly 600 in block 1133 and the process ends at block 1139.

In various embodiments, the programmable lock mechanism 650 can further comprise a process 1140 for deleting all stored codes (i.e., prior to transferring ownership of the gun safety system 10 or the like). In various embodiments, the process 1140 comprises entering a first setup command in block 1111 (e.g., double pressing a button as described previously herein). Then, the user can enter the master passcode that was set up via the process 1110 (block 1142). Next, the user can enter a clearing setup command in block 1143. In this regard, the clearing setup command in block 1143 is different from the setup command in block 1123. For example, if the setup command in block 1123 is pressing one of the setup button 654 or the main button 652 for 10 seconds, the setup command in block 1143 can be pressing one of the setup button 654 or the main button 652 for 15 seconds. In various embodiments, in response to the setup command being pressed in block 1143, a memory of the programmable lock mechanism 650 can be cleared from all codes stored therein (block 1144). In this regard, the user can proceed to test the system in block 1145 by entering the master passcode. If the lid 121 opens in block 1146, the memory was not cleared, and the user can repeat the process 1140 to properly clear the memory of the programmable lock mechanism 650. If the lid 121 opens in block 1146, the process 1140 ends at block 1149 and all passcodes will have been cleared from a memory of the programmable lock mechanism 650. In this regard, a new user (or a current user) can perform process 1110 to enter a new master pass code for the programmable lock mechanism 650, in accordance with various embodiments.

Benefits, other advantages, and solutions to problems have been described herein regarding specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods, and apparatus are provided herein. In the detailed description herein, references to "one embodiment," "an embodiment," "various embodiments," etc., indicate that the embodiment described may include a particular feature, structure, or characteristic, but every embodiment may not necessarily include the feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Finally, any of the above-described concepts can be used alone or in combination with any or all the other above-described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible considering the above teaching.

What is claimed is:

1. A gun safety system, comprising:
a mount assembly comprising:
a mounting rail configured to be secured to a support structure; and
a first lock mechanism positioned on the mounting rail; and
a gun safe assembly comprising:
an outer housing comprising a first mounting rail guide configured to slide along the mounting rail and engage the first lock mechanism; and
an inner housing assembly disposed within the outer housing, the inner housing assembly including a sleeve at least partially defining a gun storage cavity,
wherein the first lock mechanism being accessible through the gun storage cavity in response to the gun safety system being in a docked configuration.

2. The gun safety system of claim 1, wherein the gun safe assembly further comprises a door assembly disposed at a first longitudinal end of the gun safe assembly, the door assembly configured to transition between a locked configuration and an unlocked configuration.

3. The gun safety system of claim 2, wherein:
the door assembly comprises a lid,
the gun safe assembly comprises a second lock mechanism, and
the second lock mechanism configured to couple the lid to the inner housing assembly.

4. The gun safety system of claim 1, further comprising a bumper stock coupled to the outer housing assembly, wherein:
the bumper stock is configured to:
wrap around an upper portion of a handle of a gun; and at least partially define a slot, and
the handle of the gun is configured to extend through the slot and out of the gun storage cavity in response to being in a stored state.

5. The gun safety system of claim 1, wherein:
the first mounting rail guide is coupled to a first outer surface of the outer housing, and
the first mounting rail guide extends longitudinally along the first outer surface.

6. The gun safety system of claim 5, wherein:
the outer housing comprises a second mounting rail guide,
the second mounting rail guide disposed on a second outer surface of the outer housing, and
the second outer surface is different from the first outer surface.

7. The gun safety system of claim 6, wherein:
the outer housing comprises a third mounting rail disposed on a third outer surface of the outer housing,
the first outer surface creates a first edge with the second outer surface, and
the second outer surface creates a second edge with the third outer surface.

8. The gun safety system of claim 1, wherein:
the first lock mechanism comprises a button,
the outer housing comprises an aperture, and
the button is configured to extend at least partially into the aperture to be accessible from within the gun storage cavity and lock the outer housing to the mount assembly in response to the gun safe assembly being in the docked configuration.

9. The gun safety system of claim 8, wherein the aperture is disposed within the first mounting rail guide.

10. A gun safe assembly for securing an inserted firearm, comprising:
an outer housing;
a door assembly coupled to the outer housing, the door assembly including a lid and a latch arm coupled to the lid;
an inner housing assembly disposed within the outer housing, the inner housing assembly comprising:
a sleeve having an inner surface and an outer surface, the inner surface at least partially defining a cavity; and
a lock mechanism disposed on the outer surface of the sleeve of the inner housing assembly, the lock mechanism configured to engage the latch arm to transition the gun safe assembly from an unlocked configuration to a locked configuration; and a stock bumper coupled to a lower portion of the outer housing and configured to:

wrap around at least three sides of an upper portion of a grip of the inserted firearm; and define a slot in combination with the lid, wherein the grip of the inserted firearm extends downwardly through the slot and away from the cavity.

11. The gun safe assembly of claim 10, wherein the outer housing comprises a first mounting rail guide extending longitudinally along a first surface of the outer housing.

12. The gun safe assembly of claim 11, wherein the first mounting rail guide and the outer housing are a monolithic component.

13. The gun safe assembly of claim 11, wherein the outer housing further comprises a second mounting rail guide extending longitudinally along as second surface of the outer housing.

14. The gun safe assembly of claim 10, wherein the inner housing assembly further comprising an electronic system coupled to the sleeve, the electronic system including a global positioning system ("GPS") tracker and an electronic device configured for shortrange radio frequency communication.

15. The gun safe assembly of claim 10, further comprising a sensor in electronic communication with the lock mechanism.

16. The gun safe assembly of claim 10, further comprising an end cap coupled to the outer housing, wherein:

the door assembly is disposed at a first longitudinal end, the end cap is disposed at a second longitudinal end, and the second longitudinal end is opposite the first longitudinal end.

17. The gun safe assembly of claim 10, further comprising a power source in electrical communication with the lock mechanism.

18. The gun safe assembly of claim 10, wherein the lid is configured to be flush with the outer housing in response to the gun safe assembly being in a locked state.

19. A method of using a gun safety system, the method comprising:

sliding a mounting rail guide of a gun safe assembly along a mounting rail of a mount assembly until a locking mechanism of the mount assembly engages the gun safe assembly to form a docked configuration for the gun safety system, wherein:

the locking mechanism is positioned on the mounting rail;

the mounting rail guide is disposed along an outer surface of the gun safe assembly; and the locking mechanism is accessible from an inner gun storage cavity of the gun safe assembly in the docked configuration;

transitioning the gun safe assembly from a locked state to an unlocked state; and disengaging the locking mechanism through the gun storage cavity and sliding the gun safe assembly along the mounting rail to transition from the docked configuration to a portable configuration.

20. The method of claim 19, wherein the transitioning the gun safe assembly from the locked state to the unlocked state further comprises disposing a radiofrequency identification (RFID) tag adjacent to an RFID sensor of the gun safe assembly.

* * * * *